US008667752B2

(12) United States Patent
Pollack

(10) Patent No.: US 8,667,752 B2
(45) Date of Patent: Mar. 11, 2014

(54) INTERLOCKING CONSTRUCTION SYSTEMS AND METHODS

(71) Applicant: Robert Pollack, Chappaqua, NY (US)

(72) Inventor: Robert Pollack, Chappaqua, NY (US)

( * ) Notice: Subject to any disclaimer, the term of this patent is extended or adjusted under 35 U.S.C. 154(b) by 0 days.

(21) Appl. No.: 13/844,776

(22) Filed: Mar. 15, 2013

(65) Prior Publication Data

US 2013/0279979 A1 Oct. 24, 2013

Related U.S. Application Data

(63) Continuation-in-part of application No. 13/633,866, filed on Oct. 2, 2012, which is a continuation of application No. 13/101,334, filed on May 5, 2011, now abandoned, which is a continuation of application No. 12/823,948, filed on Jun. 25, 2010, now abandoned.

(51) Int. Cl.
*E04B 1/70* (2006.01)

(52) U.S. Cl.
USPC ..... 52/302.1; 404/34; 404/41

(58) Field of Classification Search
USPC ..... 52/302.1; 404/34, 38, 39, 40, 41
See application file for complete search history.

(56) References Cited

U.S. PATENT DOCUMENTS

| | | | |
|---|---|---|---|
| 1,038,823 | A | 9/1912 | Barbour |
| 1,336,789 | A | 4/1920 | Sheen |
| 1,417,010 | A | 5/1922 | Wright et al. |
| RE16,867 | E | 2/1928 | Healy |
| 1,895,801 | A | 1/1933 | Keller |
| 1,969,729 | A | 8/1934 | Damianik |
| 2,189,218 | A | 2/1940 | Neumeister |
| 3,109,259 | A | 11/1963 | Edgar |
| 3,229,439 | A | 1/1966 | Strobel |
| 3,996,715 | A | 12/1976 | Dowse |
| 4,557,094 | A | 12/1985 | Beliveau |
| 4,593,513 | A | 6/1986 | Stratton |
| 4,773,790 | A | 9/1988 | Hagenah |
| 5,342,142 | A | 8/1994 | Barth et al. |
| 5,685,119 | A | 11/1997 | Zschoppe |
| 6,591,569 | B2 | 7/2003 | Azar |
| 6,705,797 | B1 | 3/2004 | Shohei |
| 6,863,469 | B2 | 3/2005 | Bolduc et al. |
| 6,866,446 | B2 | 3/2005 | McAllister et al. |
| 7,174,687 | B2 | 2/2007 | Ferguson |
| 7,367,167 | B2 | 5/2008 | Takayanagi |
| 2003/0007834 | A1 | 1/2003 | Bolduc et al. |
| 2009/0113835 | A1 | 5/2009 | Banova |
| 2009/0249734 | A1 | 10/2009 | Karau |

OTHER PUBLICATIONS

Custom Homes Turn to Concrete Masonry for Superior Structure, Mortarless Technologies, pp. 18-19, Jan. 1999.

(Continued)

*Primary Examiner* — Mark Wendell
(74) *Attorney, Agent, or Firm* — Brian R. Pollack; Day Pitney LLP

(57) ABSTRACT

The disclosure provides, among other things, a paver that includes a body having a top surface, a bottom surface opposite the top surface, and a peripheral side. The peripheral side is defined about a perimeter of the paver and joins the bottom and top surfaces. The peripheral side defines a peripheral edge displaced from the top surface and the bottom surface that traverses the perimeter of the body along the peripheral side. The edge is adapted to engage a complementary edge on a peripheral side of an adjacent paver, such that the pavers interlock when a vertical force is applied to the paver. In another aspect, a masonry wall unit is provided for building walls similar in concept to the paver.

20 Claims, 35 Drawing Sheets

(56) References Cited

OTHER PUBLICATIONS

VanderWerf, Pieter, "Mortarless Block Systems", Masonry Construction, Feb. 1999.

Mortarless Masonry Block System 'Connex' by Boral Masonry Limited, © Boral Masonry 2005.

USPTO Non-Final Office Action, in related U.S. Appl. No. 12/823,948, dated Sep. 1, 2010.

USPTO Final Office Action, in related U.S. Appl. No. 12/823,948, dated Jan. 28, 2011.

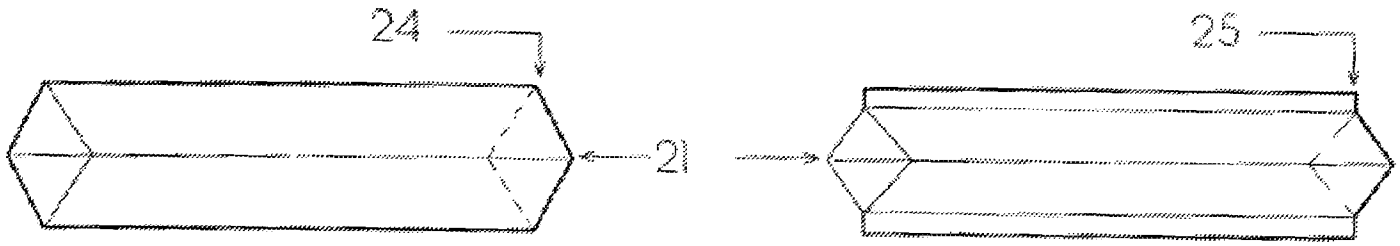
Fig. 20
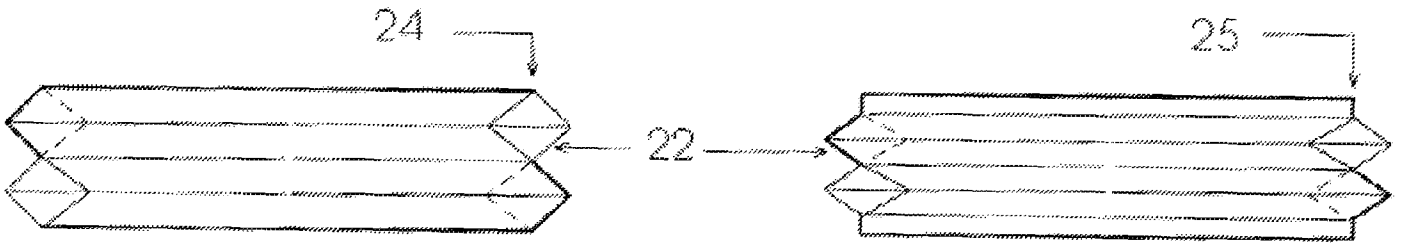
Fig. 21
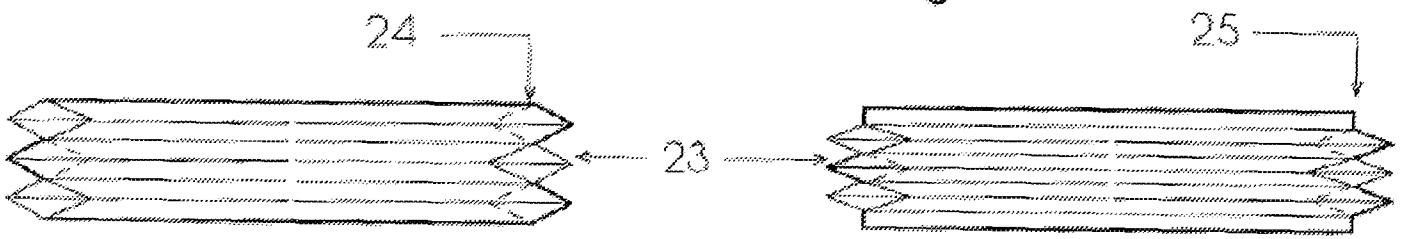
Fig. 22
Fig. 23
Fig. 24
Fig. 25

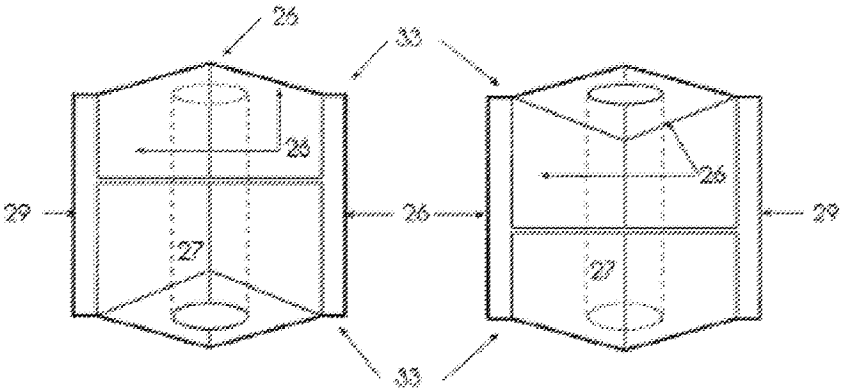
Fig 27
Fig 28
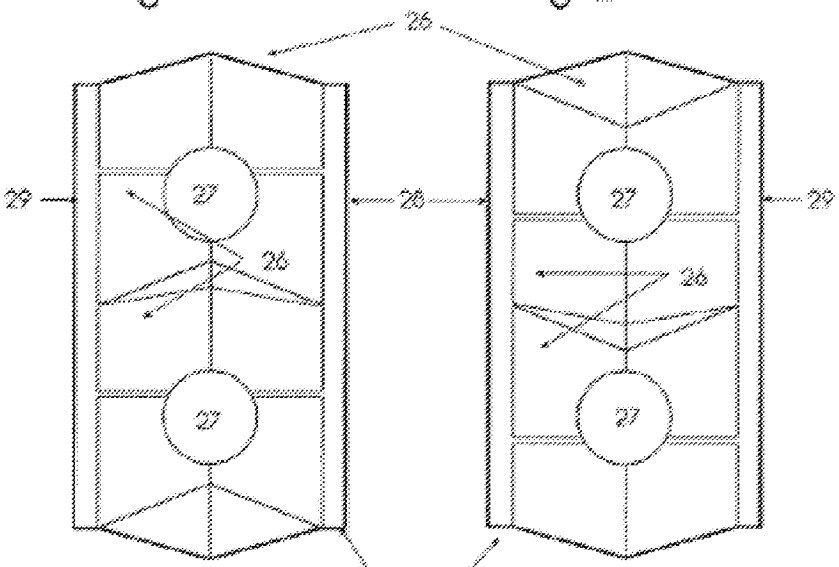
Fig 29
Fig 30
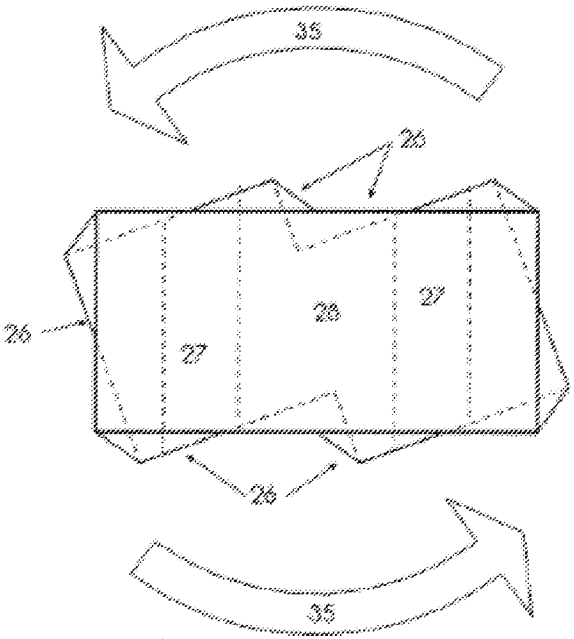
Fig 26

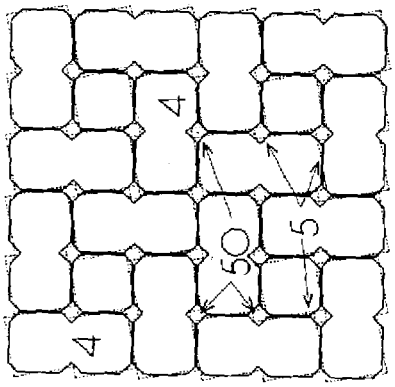
Fig. 59
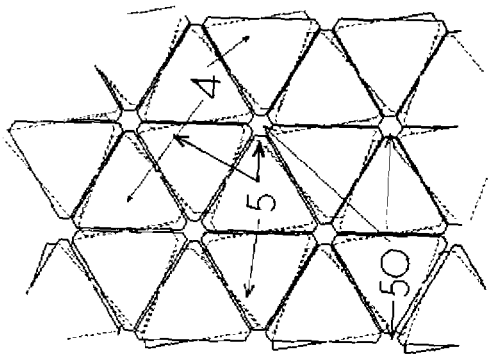
Fig. 58
Fig. 60
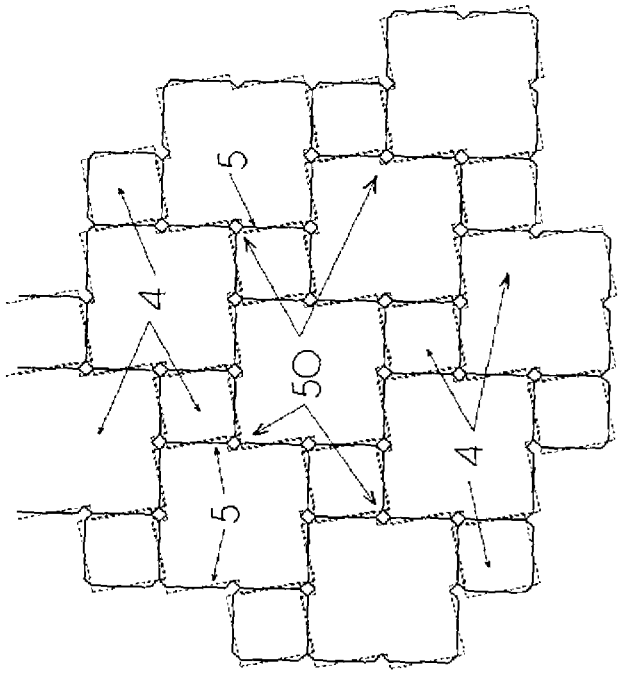
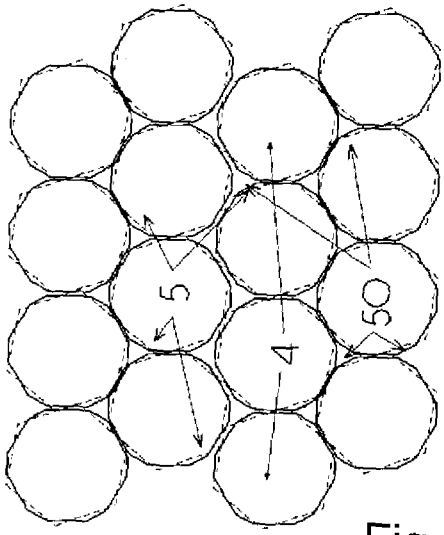
Fig. 57

INTERLOCKING CONSTRUCTION SYSTEMS AND METHODS

BACKGROUND

1. Field of the Disclosure

In one aspect, the present disclosure is directed to interlocking precast or pre-molded pavers for enhanced smoothness of paved surfaces initially and over time. In another aspect, the disclosure describes an improved unit for the construction of walls, and preferably masonry walls.

2. Description of Related Art

Hard surfaced areas primarily outside of building interiors are more frequently paved with brick, stone and precast paving units set on gravel, sand and other porous surfaces than done previously, where concrete slabs and asphalt pavement was most frequently used. The desire for more visually pleasing surfaces and environmental laws limiting paved areas impervious to water penetration, has spurred use of individual pavers permitting rain to be absorbed into the ground through open joints between each paver, thereby reducing storm discharges to existing storm water carrying systems and resultant flooding.

Individual pavers, which are increasingly manufactured of concrete, are usually set over a base of graded aggregates usually involving a base of coarse crushed stone overlayed with finer particulates. This bed is usually compacted with motorized rollers or pad type vibrators until the base is dense and smooth. The paving units are laid over this base and sometimes vibratory compaction is also applied to the installed pavers for additional resistance to vehicular settlement later in use. Sand is swept into the hand-tight joints to maintain rain water permeability.

Individual pavers known in the art interlock along a horizontal direction. All such pavers have essentially smooth edges. When concentrated loads such as vehicles must be supported as in a roadway, the repeated force of tires gradually depress pavers into the base material resulting in an uneven surface. Paved areas adjacent these vehicular paths are actually pushed higher. The resultant appearance is less than pleasing and not desirable. Moreover, snow plows tend to strike pavers that are projecting above the surface, causing damage to the pavers and occasionally the plow blade. The present disclosure provides a solution for these problems.

In another aspect, masonry units used to build walls, commonly known as concrete blocks, if made from concrete, are dependent on mortar laid between the surfaces of adjacent masonry units both vertically and horizontally. The use of mortar, containing water, restricts the construction of masonry walls to temperate climates or requires temporary closures during construction to prevent freezing of the mortar during the period when the mortar must cure. Additionally, masonry walls using mortar joints become unstable in areas that are subject to seismic disturbances. The horizontal action of earthquakes and tremors break masonry joints apart. Masonry joints turn to a sand consistency and pour out of walls built with standard smooth-edged block causing the weakening and eventual collapse of masonry walls. There are examples of prior art employing mortarless masonry units such as U.S. Pat. No. 5,685,119, which recognizes inherent problems with mortared masonry. The present disclosure also provides a solution for these problems.

SUMMARY OF THE DISCLOSURE

The purpose and advantages of the present disclosure will be set forth in and become apparent from the description that follows. Additional advantages of the disclosed embodiments will be realized and attained by the methods and systems particularly pointed out in the written description hereof, as well as from the appended drawings.

To achieve these and other advantages and in accordance with the purpose of the disclosure, as embodied herein, the disclosure includes a paver for paving surfaces. The paver includes a body having a top surface, a bottom surface opposite the top surface, and a peripheral side. The peripheral side is defined about a perimeter of the paver and joins the bottom and top surfaces. The peripheral side defines a peripheral edge displaced from the top surface and the bottom surface that traverses the perimeter of the body along the peripheral side. The edge is adapted to engage a complementary edge on a peripheral side of an adjacent paver, such that the pavers interlock when a vertical force is applied to the paver.

In accordance with a further aspect, the peripheral edge is continuous around the perimeter of the paver. In one embodiment, the peripheral edge of the paver defines at least one plane. The plane can be parallel or not parallel to the top surface and bottom surface. The plane can define a projection in the plane of the top surface of the paver, wherein a perimeter defined by the projection is not co-located with a perimeter of the top surface of the paver. However, the aforementioned projection of the paver preferably has the same surface area as the top or bottom of the paver. Whether or not the plane is parallel with the bottom or top surface of the paver, the plan can be rotated or otherwise displaced with respect to the top surface and bottom surface of the paver by a predetermined angle. The predetermined angle can be between about one degree and about forty five degrees, between about five degrees and about fifteen degrees, and between about fifteen degrees and about forty five degrees, most preferably between about ten degrees and about fifteen degrees, in any desired angular increment, such as one degree.

In accordance with another aspect, the peripheral edge can define a repeating pattern along at least one edge of the paver. The resulting top surface of the paver can be rectangular in shape. By way of further example, the top surface of the paver can be hexagonal, square or triangular in shape, among others. Preferably, the peripheral edge resembles a continuous helical pattern along at least two contiguous sides of the paver. The disclosure also provides a related method of paving a surface, comprising providing pavers with interlocking edges that prevents relative vertical displacement of the pavers once the pavers are installed, as described herein, and installing the pavers. If desired, an edging member with a complementary profile that complements the edges of the pavers can be provided to mate with a periphery of the installed pavers.

In accordance with a further aspect of the disclosure, a masonry wall unit is provided for building walls. The masonry wall unit is similar in concept to the paver of the disclosure, but is turned up on edge, comparatively speaking. The masonry wall unit has a body including a first side surface, a second side surface opposite the first side surface, and top, bottom, and two opposing ends joining the first and second side surfaces. A peripheral edge is defined along the top, bottom and two opposing ends displaced from the side surfaces that traverses a perimeter of the body along the top, bottom and two opposing ends. The peripheral edge is adapted to engage a complementary edge on a peripheral top, bottom, or opposing end of an adjacent masonry wall unit, such that the masonry wall units interlock when a horizontal force is applied to a wall constructed from the masonry wall units.

In accordance with a further aspect, the peripheral edge can define a repeating pattern along at least one edge of the masonry wall unit. The masonry wall unit is preferably oblong in shape. Aspects of the pavers described above can equally be applied to the masonry wall unit. For example, in one embodiment, the peripheral edge of the unit can define at least one plane. The plane can be parallel or not parallel to the side surfaces. The plane can define a projection in the plane of the side surfaces of the unit, wherein a perimeter defined by the projection is not co-located with a perimeter of the side surfaces. However, the aforementioned projection of the unit preferably has the same surface area as the sides of the unit. Whether or not the plane is parallel with the sides of the unit, the plane can be rotated or otherwise displaced with respect to the sides of the unit by a predetermined angle. The predetermined angle can be between about one degree and about forty five degrees, between about five degrees and about fifteen degrees, and between about fifteen degrees and about forty five degrees, most preferably between about ten degrees and about fifteen degrees, in any desired angular increment, such as one degree. It will be further appreciated that the peripheral edge of any embodiment of a masonry unit or paver herein need not be a sharp line, but may be rounded at a predetermined radius, such as ¼ inch, ½ inch, ¾ inch, 1 inch, or any other desired radius. It will be further appreciated that the disclosure provides a mortarless masonry wall including a plurality of masonry wall units wherein all sides of the pavers interlock horizontally. Similarly, it will be appreciated that the disclosure provides mortarless paved surface including a plurality of pavers, wherein a all sides of the pavers interlock vertically.

It is to be understood that both the foregoing general description and the following detailed description are exemplary and are intended to provide further explanation of the embodiments disclosed herein.

The accompanying drawings, which are incorporated in and constitute part of this specification, are included to illustrate and provide a further understanding of the method and system of the disclosure. Together with the description, the drawings serve to explain the principles of the disclosed embodiments.

BRIEF DESCRIPTION OF THE DRAWINGS

FIG. 20 is a side view of a paver with a single helical spline in accordance with the present disclosure.

FIG. 21 is a side view of a paver with a double helical spline in accordance with the present disclosure.

FIG. 22 is a side view of a paver with a triple helical spline in accordance with the present disclosure.

FIG. 23 is a side view of a paver with a single helical spline and a face projection on each face in accordance with the present disclosure.

FIG. 24 is a side view of a paver with a double helical spline and a face projection on each face in accordance with the present disclosure.

FIG. 25 is a side view of a paver with a triple helical spline and a face projection on each face in accordance with the present disclosure.

FIG. 26 is the face of a wall unit with a helical spline configuration on all four contact sides in accordance with the present disclosure.

FIG. 27 is a side view of a first side of the unit of FIG. 26 showing the helical spline joint.

FIG. 28 is a side view of a second side of the unit of FIG. 26 showing the other side helical spline joint.

FIG. 29 is a view of the top of the unit of FIG. 26 showing the helical spline surface.

FIG. 30 is a view of the bottom of the unit of FIG. 26 showing the helical spline surface.

FIG. 31 illustrates a helical spline joint that begins at the block faces.

FIGS. 41-60 Illustrate a second version of the blocks having chamfered corners to enhance drainage.

DETAILED DESCRIPTION

Figure 1:
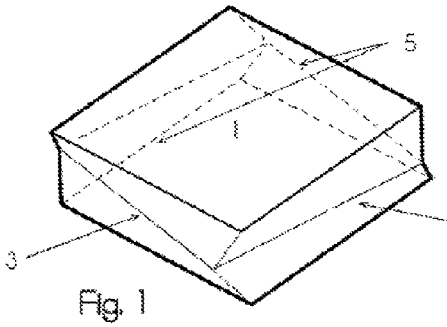
FIG. 1 is an isometric view of a square paver made in accordance with the present disclosure.

Reference will now be made in detail to the present preferred embodiments of the disclosure, examples of which are illustrated in the accompanying drawings. The method and corresponding steps of the disclosed embodiments will be described in conjunction with the detailed description of the system.

The devices and methods presented herein may be used in place of pavers and construction blocks, such as masonry blocks, of the prior art. In particular, a joint configuration is employed for pavers and wall block units that act as both a tongue and a groove in the same surface. All abutting surfaces of pavers are the preferably same and all abutting surfaces of masonry wall units are preferably the same. With oblong rectangular pavers and masonry units, the present joint configuration permits short sides to interlock with long sides when the units are laid on the block module with joints lining-up.

Preferably, the joint configuration forms what is referred to herein as a double helical shape which changes from a depression at one end to a projection at the other. These surfaces match the surfaces of abutting units. The negative and positive voids and projections perfectly fit into one another creating a firm and rigid interlock that resists separation by natural forces such as frost upheaval and shaking action of kinetic loads such as vehicular traffic and natural earth tremors. In walls, it is believed that such vibration along with gravity will not only not damage the integrity of such a structure, but may actually improve the stability of the assembly. Masonry wall units provided in according with the teachings herein may have voids with present concrete blocks, for example, for grouting of steel reinforcement, handholds, and to reduce weight of the unit for ease in lifting.

Also described herein is a series of paver designs employing what is referred to herein as a helical interlocking joint and wall units, such as masonry wall units, along with some necessary adapting masonry unit items useful to complete a structure. Additionally, standard masonry block, as currently used, can be also employed in the same wall to account for odd dimensions or unique structural conditions. For that reason, the height of a block with the interlock is preferably slightly greater than a standard masonry unit which usually has approximately ½" of mortar. In order for the interlocking block to line up with mortared block, the actual effective height will probably be 8 inches, which is the same as a standard block of 7 and ½ inches plus the ½ inch joint. Eight inches has been used as a standard construction dimension for many years, as three courses at eight inches each equals two feet even. Similarly, the standard size of structural brick with a mortar joint has been five courses of brick equaling two feet for several hundred years. When concrete masonry units came into use, it was in concert with brick and the 7½" height of masonry units was established. Masonry units are generally made of concrete, though other materials have been used such as cinders, light weight concrete, gypsum, and recycled amalgams containing inert aggregates and binders as will likely become more common in the future.

The disclosed interlocking joint configurations in both rectangular pavers and masonry wall units permit all edges of pavers to interlock and all edges of wall masonry units to interlock. Because no mortar is required in concrete wall units, if no mortar is used, it is preferably to seal walls against the incursion of air, and water when enclosing conditioned space. A number of remedies are available, such as a bead of caulking on contacting unit surfaces near the outside face of the wall. If desired, for example, a thin liner of polyethylene foam can be laid onto a lower course of block and abutting side block as block is laid.

There are a number of variants possible with the employment of this interlock configuration. Pavers and wall units can have multiples of the device on each edge, such as a plurality of helical tongue-groove elements adjacent one another or separated by smooth bands.

In one aspect, the disclosed wall units can be used to make retaining walls combining layered soil textiles as is done with many systems, such as Keystone Retaining Systems Minneapolis, Minn. and Anchor Wall Systems of Minnetonka, Minn. Retaining walls built with these systems are laid without mortar permitting drainage of hydrostatic moisture from behind the wall to drain through at any location of the wall preventing built-up moisture from freezing in winter and expanding which could, ultimately be expected to overturn a wall not so constructed. Soil engineers design such walls and employ decay-proof fabrics to be layered into the deposited soil and into joints in the block wall. These joints secure the fabric into the wall with shear pins inserted approximately every foot of the wall's length. This can put a great deal of stress on the fabric which holds the wall in place resisting the outward thrust of the retained soil. When enough pins have ripped through the fabric, failure of the wall can occur. If interlocking block as described herein is used in this type of retaining wall, the fabric can be laid so that it covers the entire thickness of the block wall and a new course laid over securing the fabric to the block more continuously and distributing the forces more evenly. It is believed that this will reduce the possibility of failure.

Pavers

FIG. 1 is an isometric view that illustrates a square paver with a helical spline interlocking edge in accordance with the present disclosure. As will be appreciated, the helical edge 3 is helical in the sense that it wraps around at least two contiguous sides of the paver in a helical fashion. The edge 3 is applied to all four sides, and can define a plane that may or may not be parallel to the faces of the paver. The edge may be a sharp line, or may be rounded having a radius of curvature, for example, of ¼, ½, ¾ or 1 inch, among others. Reference 1 indicates the top of the paver. Reference 5 indicates lines of the other spline edges that cannot be seen. The paver may be nominally any size, such as a nominal standard size that is commonly available in the field, such as 4"×4", 6"×6", 8"×8", 12"×12", and so on. With regards to thickness, the paver is preferably about 2 inches to 3 inches thick, or as desired.

Figure 4:
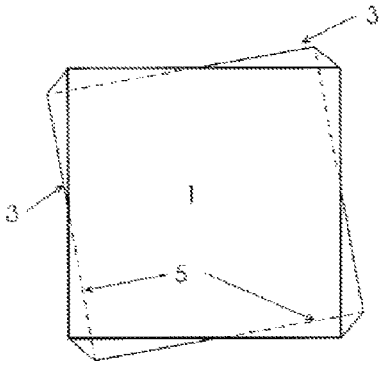
FIG. 4 is a top view of a square paver made in accordance with the present disclosure.

As is apparent from FIG. 4, the peripheral edge is continuous around the perimeter of the paver. As is evident from FIG. 4, the peripheral edge of the paver defines a plane, whereas the peripheral edge defines two distinct planes in the paver of FIG. 3. The plane can be parallel or not parallel to the top surface and bottom surface of the paver. The plane can define a projection in the plane of the top surface of the paver, most visible in the plan view of FIG. 4, wherein a perimeter defined by the projection is not co-located with a perimeter of the top surface of the paver. That is to say, they are offset. However, the aforementioned projection of the paver preferably has the same surface area as the top or bottom of the paver to simplify alignment and assembly of the pavers.

Figure 2:
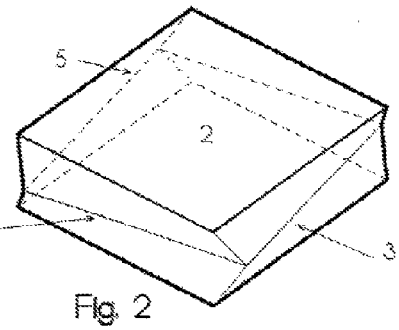
FIG. 2 is an isometric view of a square paver with an opposite rotation of the helical spine.

FIG. 2 is an isometric view of a square paver with a helical spline interlocking edge. Reference 2 indicates either the bottom face of the paver of FIG. 1, or, if the paver has a different finish on each face, such as surface toned to resemble burned brick on the exposed surface, FIG. 2 may be considered a paver with a spline shape generated with an opposite rotation in comparison to FIG. 1 as will be explained later.

Figure 3:
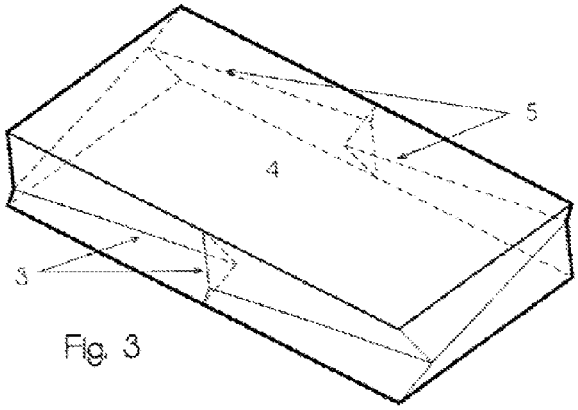
FIG. 3 is an isometric view of an oblong rectangular paver made in accordance with the present disclosure.

FIG. 3 illustrates an oblong rectangular paver having a length that is twice its width. Reference 3 indicates the helical spine interlocking edge, which is two of the short joint configurations as illustrated in FIGS. 1-2 in succession on the long sides of the paver. Dimensions may be any commonly used sizes such as 4"×8", 6"×12", 8"×16", or as desired. Thickness can be 2" to 3" or as required. For example, vehicular paved areas may require greater thickness than pedestrian ones. Reference 4 is the face of the paver and reference 5 indicates the spline joints on the two sides that are out of view.

FIG. 4 shows a square paver indicating the generation of the helical spline edge. Reference 1 is the paver face. Reference 3 indicates the portions of the joints projecting beyond the dimension of the face. Reference 5 indicates the portions of the joints which are not seen. They are recessed within the dimensions of the face.

Figure 5:
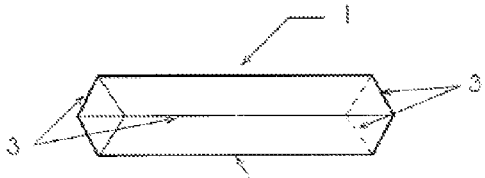
FIG. 5 is a side or edge view of a paver with the helical spline made in accordance with the present disclosure.

FIG. 5 is the side view of a paver showing the helical spline joint. Reference 1 points to the paver face. Reference 2 indicates the bottom, and reference 3 points to the spline joint indicating the protruding and recessed portions. Also indicated is the center plane of the joint along-which the maximum projections and recesses occur.

Figure 6:
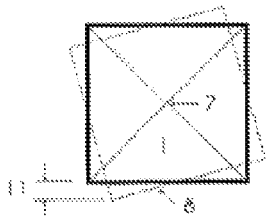
FIG. 6 is a top view of a square paver made in accordance with the present disclosure with a helical spline created by a 15 degree rotation of the central plane of the paver.

FIG. 6 is the face of a square paver indicating the generation of a helical spline joint by rotation of the central plane about the center of the paver, 1, for a rotation of 15 degrees which results in a the maximum projection indicated by 11 of the projecting part 5.

Figure 7:
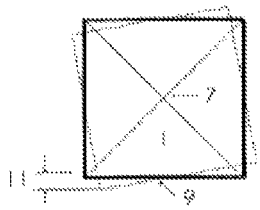
FIG. 7 is similar to FIG. 6 but with a 10 degree rotation.

FIG. 7 is the face of a square paver indicating the generation of a helical spline joint edge by rotation of the central plane about the center of the paver, 1, for a rotation of 10 degrees resulting in a maximum projection indicated by 11 of the projecting part 5.

Figure 8:
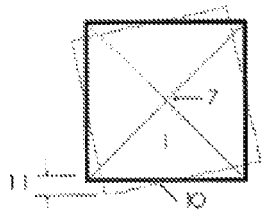
FIG. 8 is similar to FIG. 6 but with a 12 degree rotation.

FIG. 8 is the face of a square paver indicating the generation of a helical spline joint by rotation of the central plane about the center of the paver, 1, for a rotation of 12 degrees resulting in a maximum projection indicated by 11 of the projecting part 5. It will be appreciated that the degree of rotation as described herein can be varied to achieve desired performance, such as by angular increments of one degree from an increment of about one degree to about 45 degrees.

Figure 9:
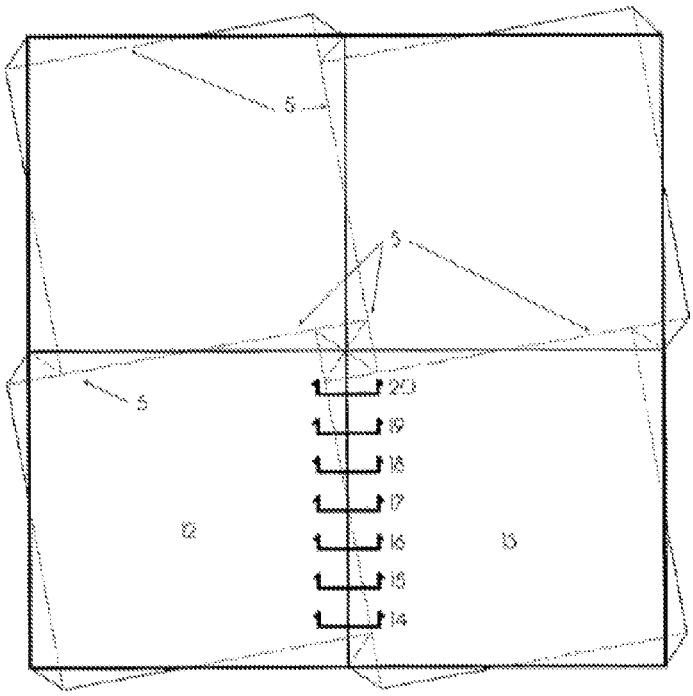
FIG. 9 is a top view of four square pavers joined together with section arrows along one of the joints in accordance with the present disclosure.

FIG. 9 illustrates four square pavers attached to each other in mutually supporting intimate contact. Reference 5 indicates edges of the helical spline joint that cannot be observed when pavers are attached. References 12 and 13 are two of the adjacent attached pavers. References 14 through 20 are section lines through the helical spline joint taken at even increments.

Figure 10:
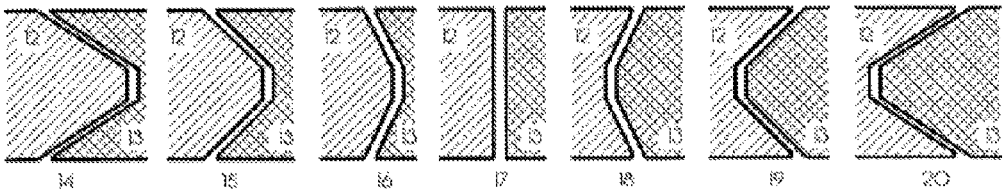
FIG. 10 is a series of partial sections at the helical edges of two abutting pavers in accordance with the present disclosure.

FIG. 10 is a series of cross sections through the helical joint connecting pavers 12 and 13 from the indicated sections in FIG. 9. Section 14 is a section where the tenon portion of paver 12 is at maximum projection and the recess of the joint of paver 13 is the deepest. Progressively, sections 15 and 16 indicate projections that are less extreme. Section 17 is a section at the center of the joint where there is no projection and no recess. The joint is essentially flush with the modular dimension of the face of the paver. Progressively, the sections of 18 and 19 indicate the projection of the tenon portion of paver 13 increases. At the section of 20, the tenon portion of paver 13 is at its maximum projection and the recess of paver 12 is at its deepest.

In all of the following illustrations FIGS. 11 through 19, reference 4 indicates the faces of pavers and reference 5 points to portions of helical joints that can not be seen when the pavers are installed. The helical joints beyond the surface of the pavers are illustrated in dashed lines.

Figure 11:
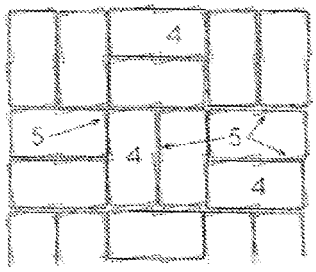
FIG. 11 is a grouping of oblong rectangular pavers forming a "basket weave" pattern in accordance with the present disclosure.

FIG. 11 is an illustration of oblong rectangular pavers in accordance with the disclosure assembled in a "basketweave" pattern. The helical joints on the short sides of the pavers have the ability to interlock with the long sides making this pattern possible. "Basketweave" is one of the most frequently used patterns in paver layouts.

Figure 12:
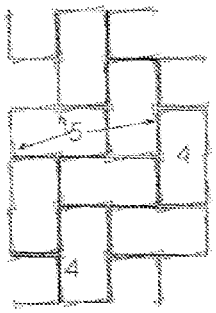
FIG. 12 is a grouping of oblong rectangular pavers forming a "herringbone" pattern in accordance with the present disclosure.

FIG. 12 is an illustration of oblong rectangular pavers in accordance with the disclosure assembled in a "herringbone" pattern. This pattern also requires short sides to abut long sides.

Figure 13:
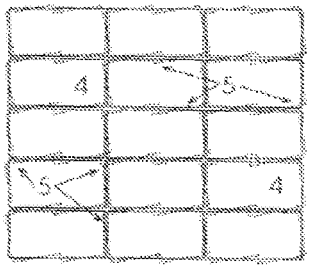
FIG. 13 is a grouping of oblong rectangular pavers forming a "stack bond" pattern in accordance with the present disclosure.

FIG. 13 is an illustration of oblong rectangular pavers in accordance with the disclosure arranged in a "stack bond" pattern.

Figure 14:
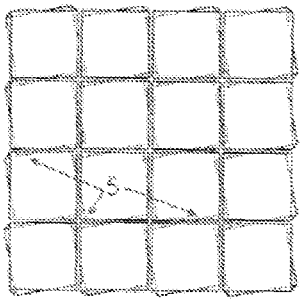
FIG. 14 is a grouping of square pavers forming a "stack bond" pattern in accordance with the present disclosure.

FIG. 14 is an illustration of square pavers in accordance with the disclosure arranged in a "stack bond" pattern which is the only pattern commonly used for square pavers. With the present technology of pavers having smooth edges, "stack bonding" offers neither a horizontal or vertical bond, preventing the pavers from locking together when even horizontal forces are applied to the pavers. In other words, there is no aspect of previously known square-edged pavers that will prevent the eventual dislocation of paver joint lines. The interlocking joint will not only prevent vertical dislocation of pavers over time, but horizontal dislocation as well.

Figure 15:
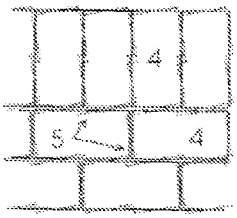
FIG. 15 is a grouping of oblong rectangular pavers with opposed rows in accordance with the present disclosure.

FIG. 15 is a portion of a paved area showing rows of oblong pavers in accordance with the disclosure in a soldier course abutting an area of running bond pavers.

Figure 16:
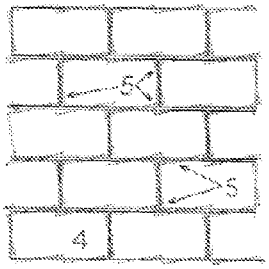
FIG. 16 is a grouping of oblong rectangular pavers in a "running bond" in accordance with the present disclosure.

FIG. 16 indicates oblong rectangular pavers in accordance with the disclosure arranged in a "running bond" pattern.

Figure 17:
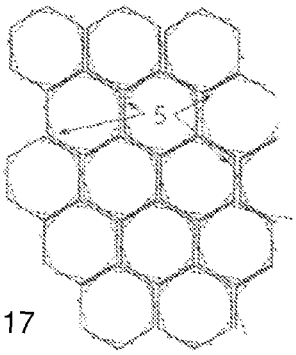
FIG. 17 is a grouping of hexagonal pavers in accordance with the present disclosure.

FIG. 17 is a hexagonal paver arrangement in accordance with the disclosure.

Figure 18:
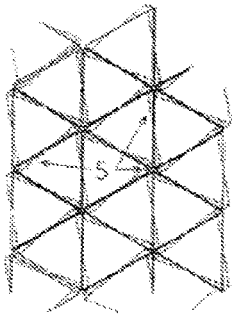
FIG. 18 is a grouping of equilaterally triangular pavers in accordance with the present disclosure.

FIG. 18 is an arrangement of a paver in accordance with the disclosure with the helical spline joint in an equilaterally triangular shape.

Figure 19:
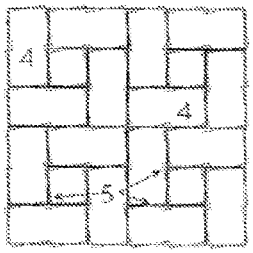
FIG. 19 is a grouping comprised of oblong rectangular and square pavers in accordance with the present disclosure.

FIG. 19 illustrates a combination of square and oblong rectangular pavers in accordance with the disclosure in a frequently used paver pattern. As is evident, the helical interlocking joint will interlock with square or rectangular pavers.

FIG. 20 shows a single helical spline 21 paver joint. Reference 24 points to the juncture of the helical joint face meeting the outside face of the paver in a flush juxtaposition.

FIG. 21 illustrates a double helical spline 22 paver joint. Reference 24 indicates the flush juncture of the helical surface and the paver face.

FIG. 22 shows a triple helical spline 23, paver joint. Reference 24 points to the flush juncture of the helical surface and the paver face.

FIG. 23 illustrates a single helical spline joint 21. Projected faces of the paver provide a reveal 25 at the juncture of the helical surface and the paver faces.

FIG. 24 illustrates a double helical spline joint 22. Projecting faces of the paver provide a reveal 25, at the juncture of the helical surface and the paver faces.

FIG. 25 shows a triple helical spline joint 23. Projecting faces of the paver provide a reveal 25 at the juncture of the helical surface and the paver faces. Embodiments of the present invention may have one or any plurality of helical spline joints and may include smooth bands separating the joints.

Vertical/Wall Unit

In additional embodiments of the present disclosure, a helical spline joint may also be applied to masonry units, such as concrete masonry units as are currently used to build walls with the application with mortar. However, it will be appreciated that other materials can be used to make the wall/masonry units besides concrete, such as a mixture of recycled material and concrete and/or polymers, fly ash and the like.

As set forth above, the problems with mortared masonry are numerous. Because mortar requires water when mixed, temperatures above freezing must be maintained during installation and curing of the mortar joints. In areas where there are seismic considerations, mortared joints are the weak aspect of masonry walls. The side to side motions of earth tremors crack and ultimately destroy mortar joints. When the mortar fragments and pours out of the joints, the wall collapses. There have been a number of attempts to develop mortarless masonry units over the years that have not resulted in their widespread use. Embodiments of the present invention preferably interlock on all abutting sides. Additionally, blocks made in accordance with the present disclosure may be laid with the long dimension run horizontally or vertically as well as a combination of both and the strength of an interlocking wall is maintained. The geometry of the helical spline joint facilitates self-centering. It is believed that, in seismically active areas, the side to side motion will cause the block to center one over the other ensuring stability.

Because there is preferably no mortar and the joints are open, there will be a tendency for weather to enter the block joints. To insure the exclusion of rain and wind convection, in buildings with conditioned space, the joints should be sealed but the sealing method is preferably not rigid. A flexible caulking bead just inside the outside block face on vertical as well as horizontal joints prior to the placing of the block may be used. Another sealing method can include placement of a thin layer of polyethylene or other foam wrap material cut into lengths equaling the combination of one vertical and horizontal block joint which may be preformed into an "L" shape and placed consecutively onto the lower block course and against the vertical side of the previously installed block. If desired, this wrap may be pre-adhered to the block during manufacture by adhesive or other suitable means.

A masonry unit made in accordance with the present disclosure may be installed on either long or short side, or a combination of both, however. It will be observed that, in the illustrated embodiment, there is an "outside" and "inside" face or, in a manner of speaking, a "right way" and a "wrong way" to orient subsequent blocks after the laying of the first block. After practice, a mason may decide to set the initial blocks for a right hand or left hand installation direction, depending on if the mason is right handed or left handed or whether the scaffolding in inside or outside of the wall.

The disclosed masonry wall unit is similar in concept to the paver of the disclosure, but is turned up on edge, comparatively speaking. The masonry wall unit has a body including a first side surface, a second side surface opposite the first side surface, and top, bottom, and two opposing ends joining the first and second side surfaces. A peripheral edge is defined along the top, bottom and two opposing ends displaced from the side surfaces that traverses a perimeter of the body along the top, bottom and two opposing ends. The peripheral edge is adapted to engage a complementary edge on a peripheral top, bottom, or opposing end of an adjacent masonry wall unit, such that the masonry wall units interlock when a horizontal force is applied to a wall constructed from the masonry wall units.

FIG. 26 is a view of the face of an exemplary masonry wall unit with helical spline joints on all four abutting sides. Reference 28 indicates the face of the block. Reference 26 indicates the helical spline joint surfaces. Holes 27 in the block may be included in any desired shape for weight reduction, hand holds and possible reinforcement. Arrows 35 indicate that the block may be rotated to a vertical or horizontal direction and interlock with other block within the wall as long as the joints align. Ideally, when using a mortarless masonry system in accordance with the present disclosure, dimensions are preferably modular in increments of 8 inches, horizontally so that cutting of the interlocking block is not necessary. However, it is believed that block may be cut and the integrity can be maintained. There are other ways of creating non-modular dimensions which will be discussed later. It will be further appreciated that, although an eight inch dimension is preferred, there is no limit on the size of the block. The block can be made smaller and manufactured from fired clay to replace traditional brick, or may be provided with heights of 12, 16, 20, 24, 30, 36 or 48 inches or larger, among others. Particularly massive blocks could be used to construct retaining walls to hold back hillsides, and can be used for constructing levies or piers or other structures at or below the water line.

FIGS. 27 and 28 are end views of the preferred masonry unit which are identical. Reference 26 points to the helical spline joint surfaces. Reference 27 indicates the voids for reduction of weight, handholds and as a place where vertical reinforcement may occur. Reference 28 is a face which must always face outside or always face inside. Reference 29 is the other face. Reference 33 indicates the projection of the face creating a reveal which may be employed or may not be.

FIGS. 29 and 30 are the top and bottom of the preferred wall/masonry unit which are also illustrated as being identical. Reference 26 indicates the helical spline joint surfaces. Reference 27 indicate the through holes, which may or may not be employed. Holes are shown in a circular shape, but may be in any preferred geometric configuration such as square, rectangular, hexagonal, and the like.

Reference 28 is a block face which must always be laid facing out or in. Reference 29 indicates the other face. Reference 33 points to the reveals if so provided. If reveals are formed into the masonry unit, they may provide a good location for the placement of a caulking bead to seal the wall against weather penetration.

Figure 31:
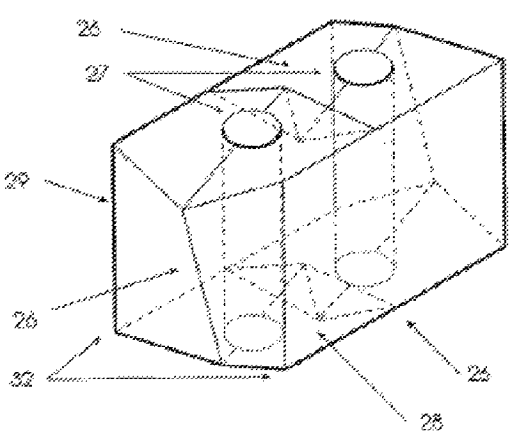
FIG. 31 is an isometric view of a wall unit in accordance with the present disclosure with helical spline joints on all four contact sides.

FIG. 31 is an isometric view of a masonry wall unit made with the present disclosure. It shows a block made without face projections. The helical surfaces extend to the front and rear faces of the block. Reference 26 points to the helical spline joint surfaces. Reference 27 indicates the voids useful for lightening the unit, providing hand holds for manual lifting of the unit, and as a location for grouting reinforcement if required for enhanced structural stability. References 28 and 29 indicate the block faces. Reference 32 points to the block face edges that indicate the helical spline surfaces terminate at the block face edge with no reveals.

Figure 32:
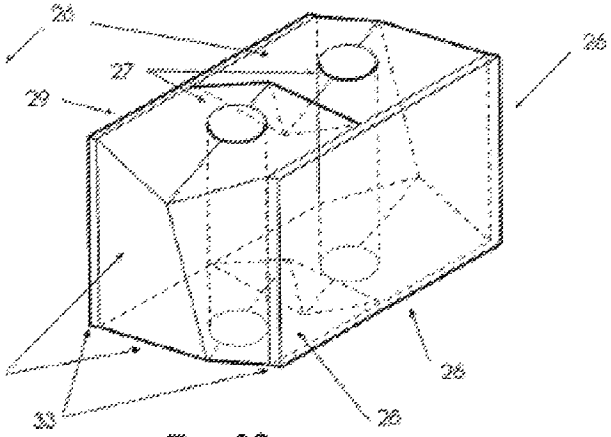
FIG. 32 is an isometric view of a wall unit with helical spline joints and a face projection on both faces in accordance with the present disclosure.

FIG. 32 is an isometric view of a masonry wall unit made with the present disclosure. It shows a block made with face projections 33. The numbering is otherwise as in FIG. 31.

Figure 33:
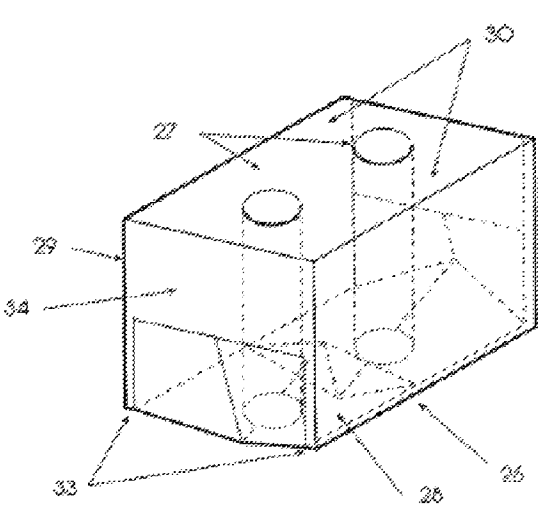
FIG. 33 is an isometric view of a wall unit with helical spline joints, face projections and a smooth solid top or bottom in accordance with the present disclosure.

FIG. 33 illustrates a block used for the bottom and top courses of a masonry wall, respectively. For the bottom course the block in FIG. 33 is used with the smooth side down. For the top course, the block of FIG. 33 is used with the smooth side and top up as shown. The top is smooth to receive superstructure. The holes, 27 may be used for grouting anchor bolts to attach the superstructure. References 28 and 29 points to the block faces, reference 26 indicates the helical spline joint surfaces. Reference 30 indicates the smooth top (or bottom, as desired). Reference 34 points to the smooth part of the block sides. This block may also be used as a finished sill block for window and door openings.

Figure 34:
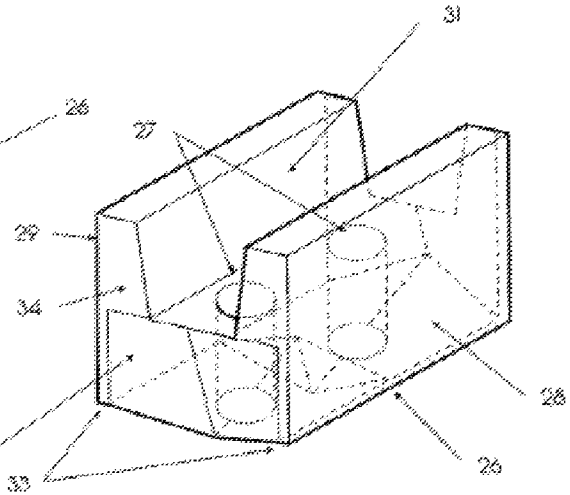
FIG. 34 is an isometric view of a wall unit with helical spline joints, face projections and a bond beam top for the addition of horizontal reinforcement in accordance with the present disclosure.

FIG. 34 is a further wall/masonry unit made with the present disclosure. It may be used as a bond beam or lintel block. Reference 26 is the helical spline surface, reference 27 indicates the voids. References 28 and 29 indicates the inside and outside block faces. Reference 33 indicates the reveals formed by the projecting block faces. Reference 34 points to the smooth part of the side and reference 31 points into the trough top, into which concrete and steel reinforcing may be placed.

Figure 35:
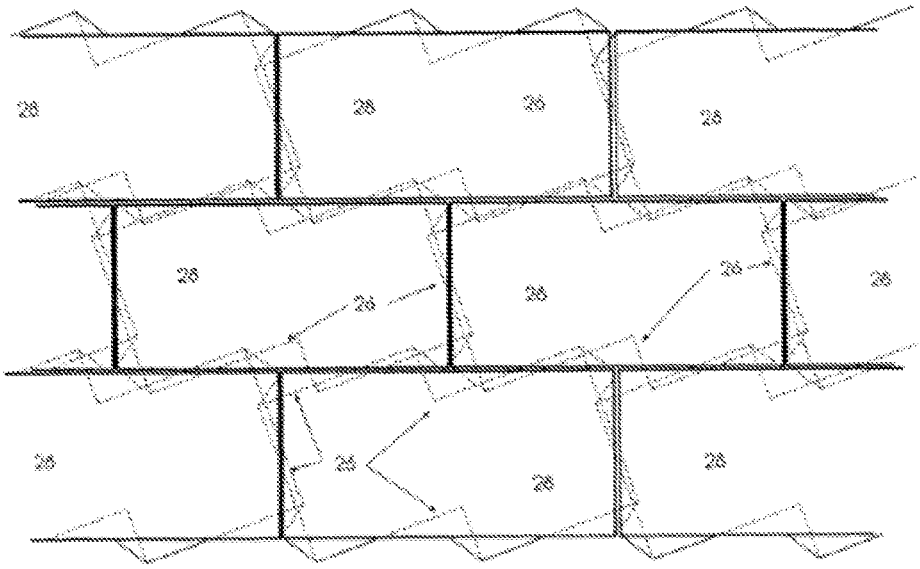
FIG. 35 is a face view of part of a masonry wall built with helical spline joints in accordance with the present disclosure.

FIG. 35 is a partial view of a portion of a masonry wall built with units made with the present disclosure. Reference 28 indicates the block face. Reference 26 points to the dashed lines indicating the lines of the helical spline joints which are internal within the wall.

Figure 36:
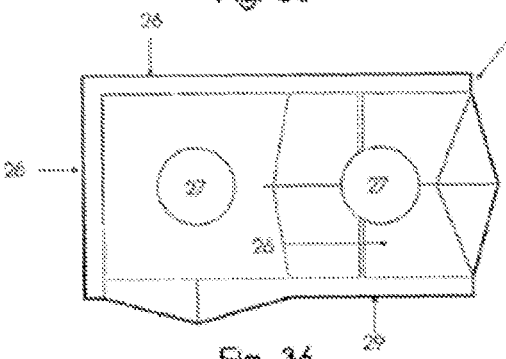
FIG. 36 is a top view of an outside corner block in accordance with the present disclosure.

FIG. 36 is an illustrative outside corner block (inside if block laid in other direction.) This corner block is laid as shown on one course and then flipped to make the next course to accommodate the ½ block shift of the running bond. Reference 26 indicates the helical spline joint surface. Reference 27 indicates the voids, 28 points to the outside face (or inside) and 29 the inside face (or outside).

Figure 37:
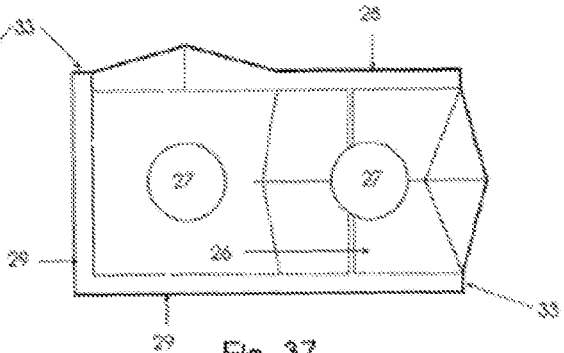
FIG. 37 is a top view of an inside corner block in accordance with the present disclosure.

FIG. 37 is an inside corner block (outside if walls are laid in other direction.) This corner block is flipped upside-down for alternate courses.

Figure 38:
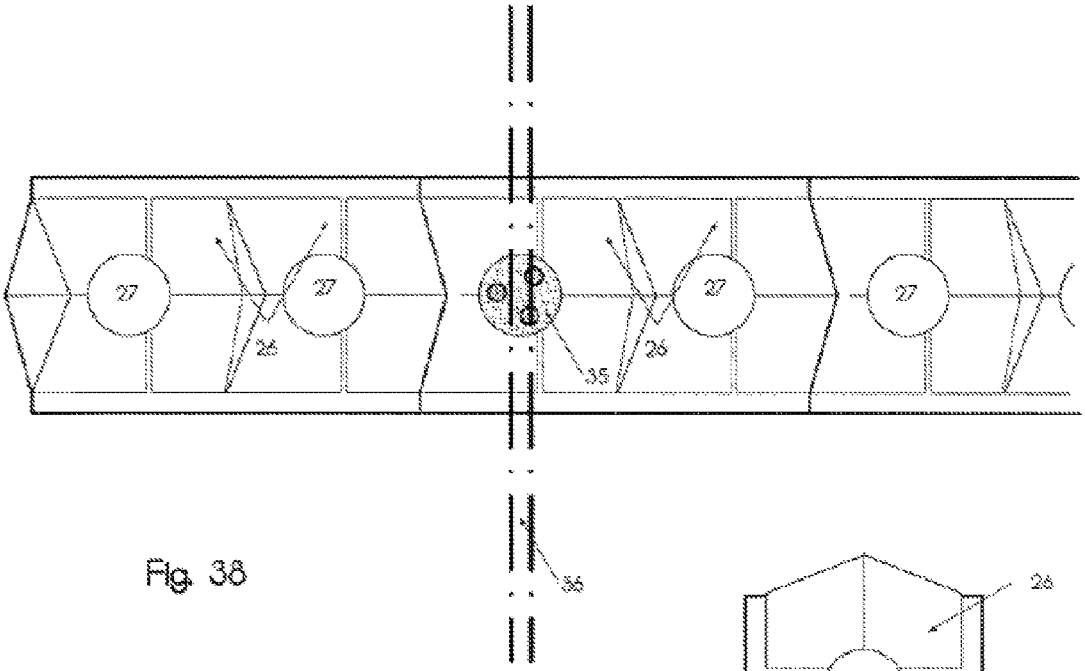
FIG. 38 is a portion of a wall at a reinforcement for a concentrated load in accordance with the present disclosure.

FIG. 38 is a plan view of a portion of a wall supporting a concentrated load such as a girder, 36 or a column or other load. Reference 26 indicates the helical spline joint surface. Reference 27 identifies the voids which may be filled solid or with reinforcing bars and grouted referenced by 35.

Figure 39:
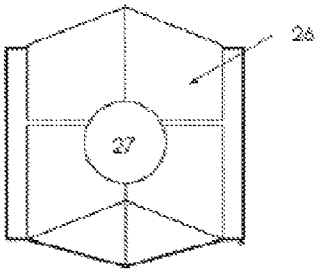
FIG. 39 is a top view of a half block in accordance with the present disclosure.

FIG. 39 illustrates a half block which will be useful with the interlocking system. With standard block, using mortar, half blocks as well as partial blocks of other dimensions, are simply broken with use of a mason's hammer and any overcutting filled with mortar. In order to take full advantage of this system in a mortarless capacity, it is possible to also provide partial and adaptive transition blocks. Moreover, a smooth end full and half block, a tee intersection block or blocks and other specialty blocks can be provided that are not specifically illustrated herein. As illustrated in FIG. 39, reference 27 indicates the void and reference 26 illustrates the helical spline joint surface.

Figure 40:
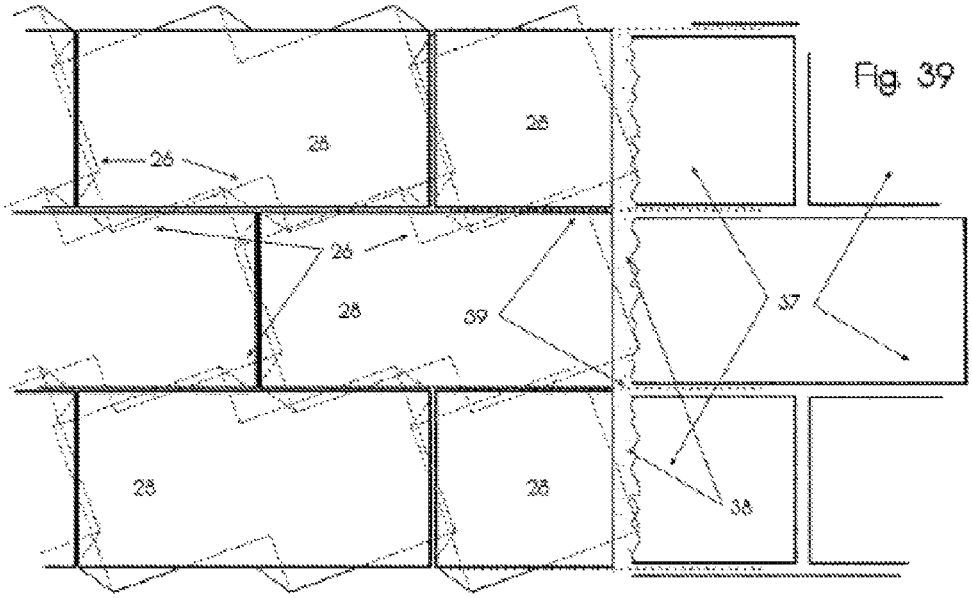
FIG. 40 is a side view where masonry units in accordance with the present disclosure abut a standard block wall.

FIG. 40 illustrates a portion of a wall built with the present disclosure abutting a conventional masonry wall which may be new or existing, as with an addition or alteration. Reference 28 indicates the faces of masonry units made in accordance with the present disclosure. Reference 26 indicates the configuration of the helical spline joints which are internal in the wall. Reference 37 indicates wall units of the existing technology. Reference 38 shows the joint between the mortarless and mortared areas of wall. Reference 39 indicates lengths of reinforcing mesh such as "geo-textile" fabric placed in the joint between layers of the interlocking helical block contact areas, and then mortared into the joints of the wall made with the existing type of masonry unit.

Walls made with the present disclosure may be laid in any weather at any ambient temperature. Extremely hot and dry climates can cause dehydration of mortar joints. No protection is required. However, extremely cold climates will freeze moisture, interfering with crystallization process during mortar curing which can weaken or destroy mortar joints. Again, mortarless joints do not have this problem. Walls with masonry with the present invention may be laid under water. It is believed that the unit made with intersecting spline joints on all sides will have greater load-bearing capacity than mortared masonry as mortar is considerably lower in compressive strength than concrete. Mortar varies in strength depending on the proportions of sand and mortar mix or the components of mortar mix such as lime and cement, the amount of water, dehydration prior to curing, and the like. Mortarless units can be manufactured in a factory where proportions are carefully monitored and the product continually tested. Because there is no need for "bite" as with mortared surfaces, the surfaces of the helical spline faces may be smoother and therefore denser, and stronger. It is believed that a smoother surface can facilitate positioning block into one another.

It is further believed that a masonry wall made in accordance with the present disclosure, having units interlocking on all sides, will be stronger and more resilient. Because of the resilience of such a wall and because there is no mortar to depend on for a wall's stability, superior performance in seismically active areas can be expected.

Perhaps the greatest advantage using masonry units made with the present disclosure, is the speed of erection. An entire building or foundation could be erected in one day. Presently, with masonry joints, only a certain number of courses may be laid in a day, as mortar must be allowed to gain a certain amount of its compressive strength before the weight of successive layers is added. With the mortarless unit, there is no need to consider curing time and an entire building could be erected, including superstructure in a day.

The disclosed block wall system is most advantageously used if building dimensions are modular. If a masonry unit made with the present invention is 16 inches long, as most existing masonry units are, ideally, the dimensions of a building and intermediate walls should be designed in 8 inch increments. That should not be a problem as most buildings generally adhere to modules of even 2 foot dimensions to accommodate other construction items such as framing lumber and plywood sheets. As previously noted, adaptation can be made for odd dimensions or if abutting existing construction.

Usually, concrete units are delivered to a construction site on pallets. They are stacked with the voids facing up. Because of the projecting portion of the helical spline, block will preferably lay on the face side for stability, and then rows of block can be nested for secure and compact shipping. Another alternative would be to use molded plastic reusable pallets containing the molded shape of the projecting splines. The pallet could be loaded by then stacking nestled blocks to any desired height for shipping. The block can then be taken right from the pallet, or laid temporarily in sand at the location, or simply laid on it face.

It is submitted that particular embodiments of blocks of the present disclosure provide superior interlocking ability of all abutting surfaces, top, bottom and sides. This is of significant advantage in seismically active areas. Additionally, masonry walls and other structures built from blocks as described herein may be laid in any weather, and even under water. Particular embodiments of pavers disclosed herein provide a vertical interlock that ensures a smoother surface more able to resist the forces of vehicular and other uneven loads as well as the effects of frost upheaval that would otherwise create an uneven surface.

Figure 41:
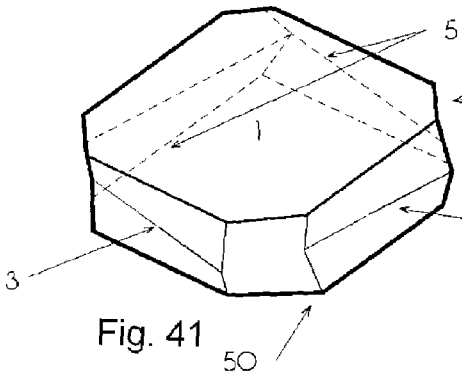
Figure 42:
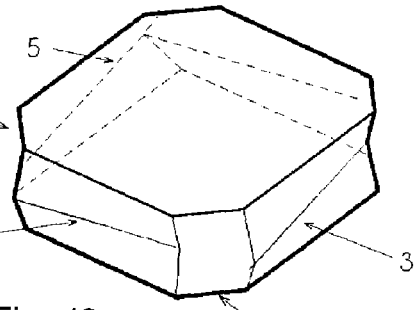
Figure 44:
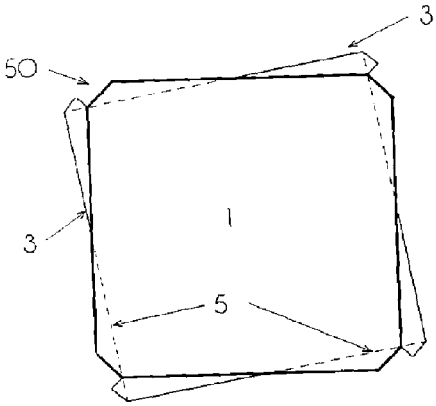
Figure 43:
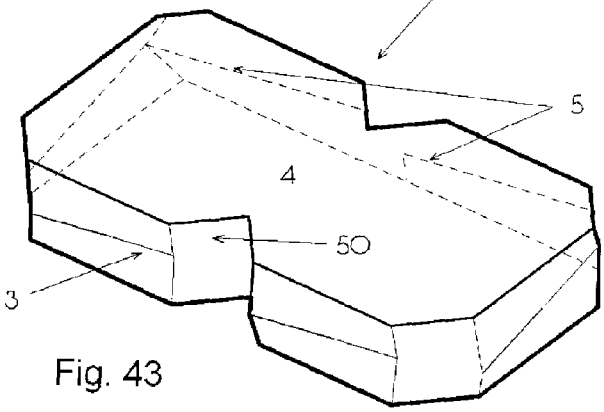
Figure 45:
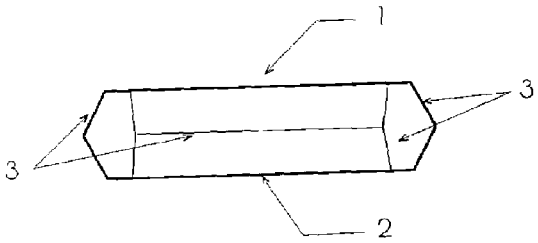
Figure 46:
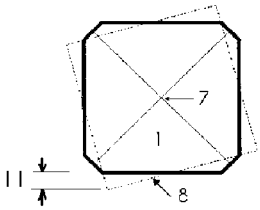
Figure 47:
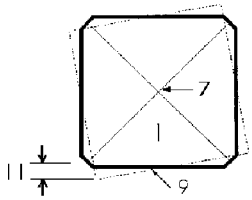
Figure 48:
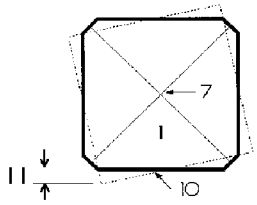
Figure 49:
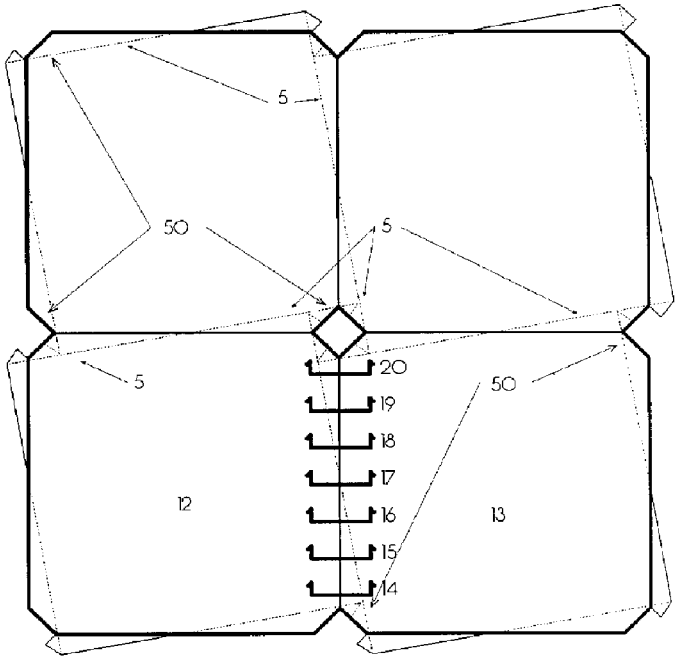
Figure 50:
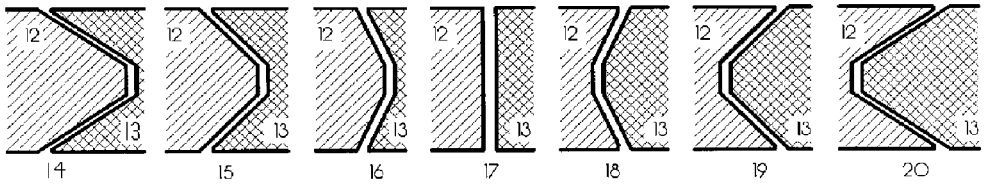
Figure 53:
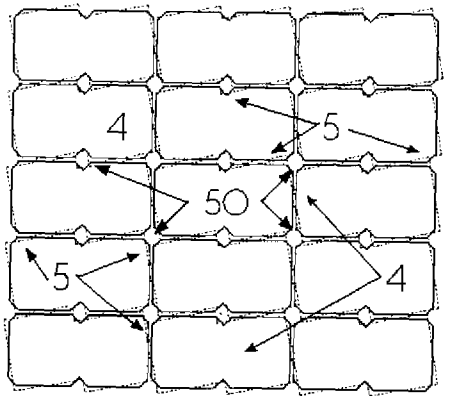
Figure 56:
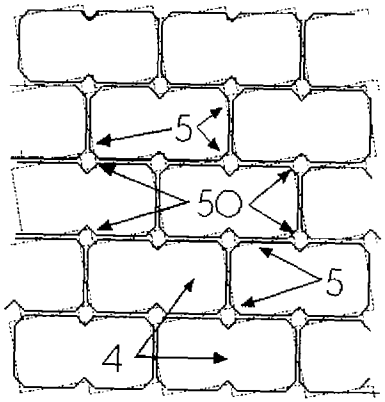
Figure 52:
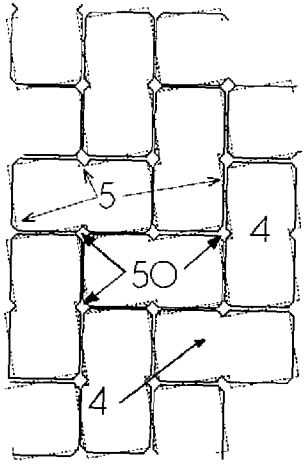
Figure 55:
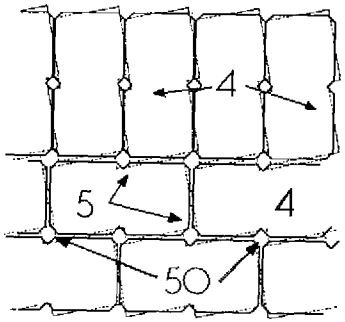
Figure 51:
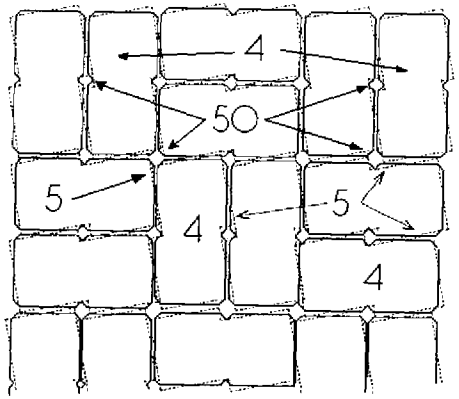
Figure 54:
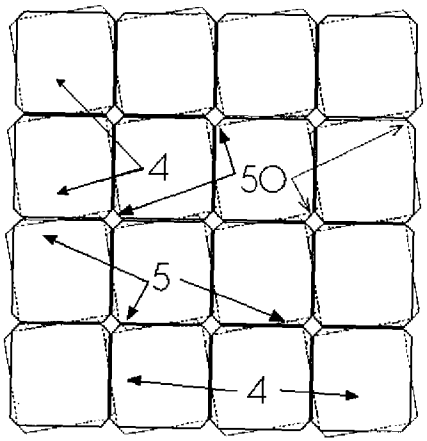
Figure 61:
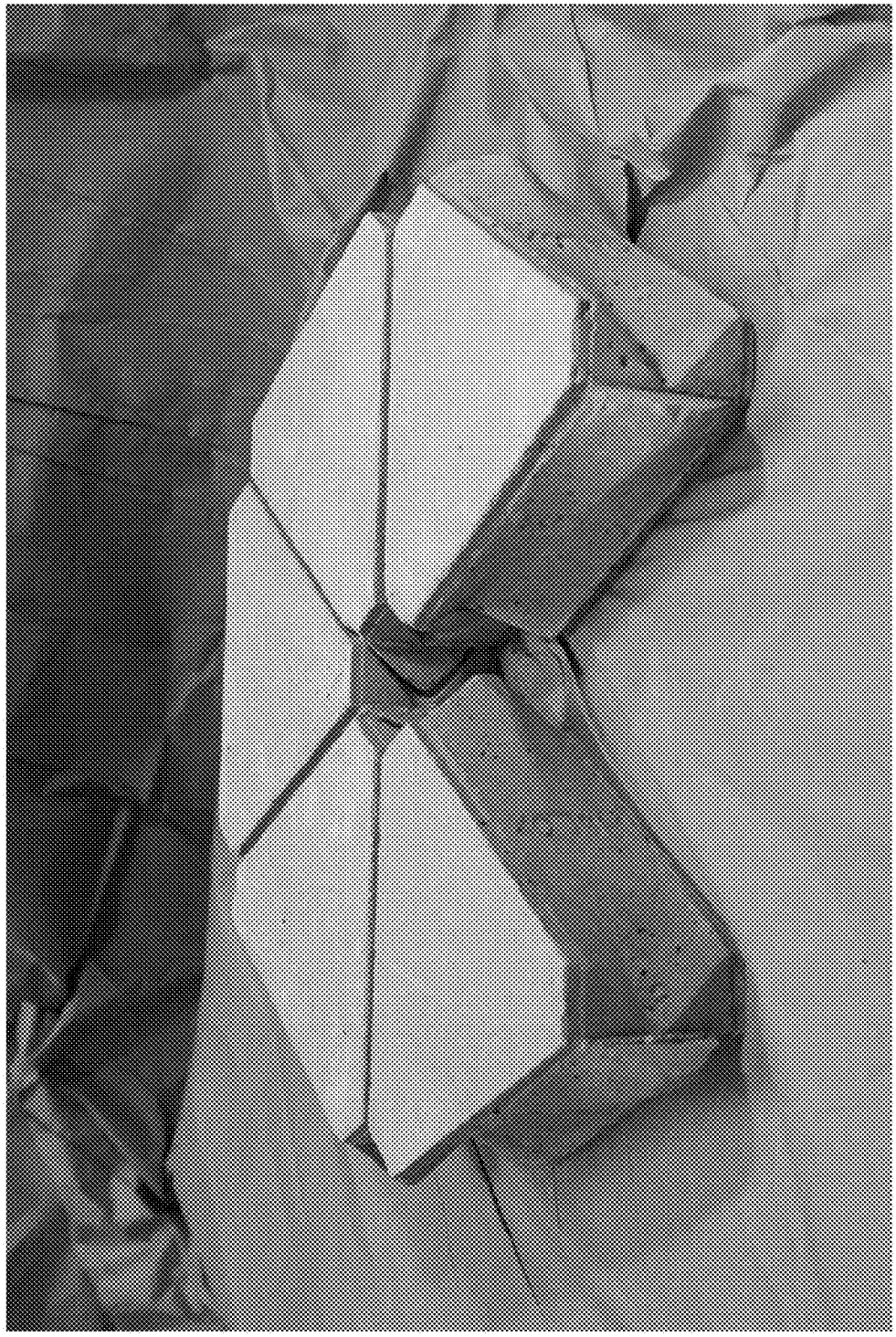
FIGS. 61-83 are photographs of actual prototypes of blocks in accordance with the disclosure.
Figure 62:
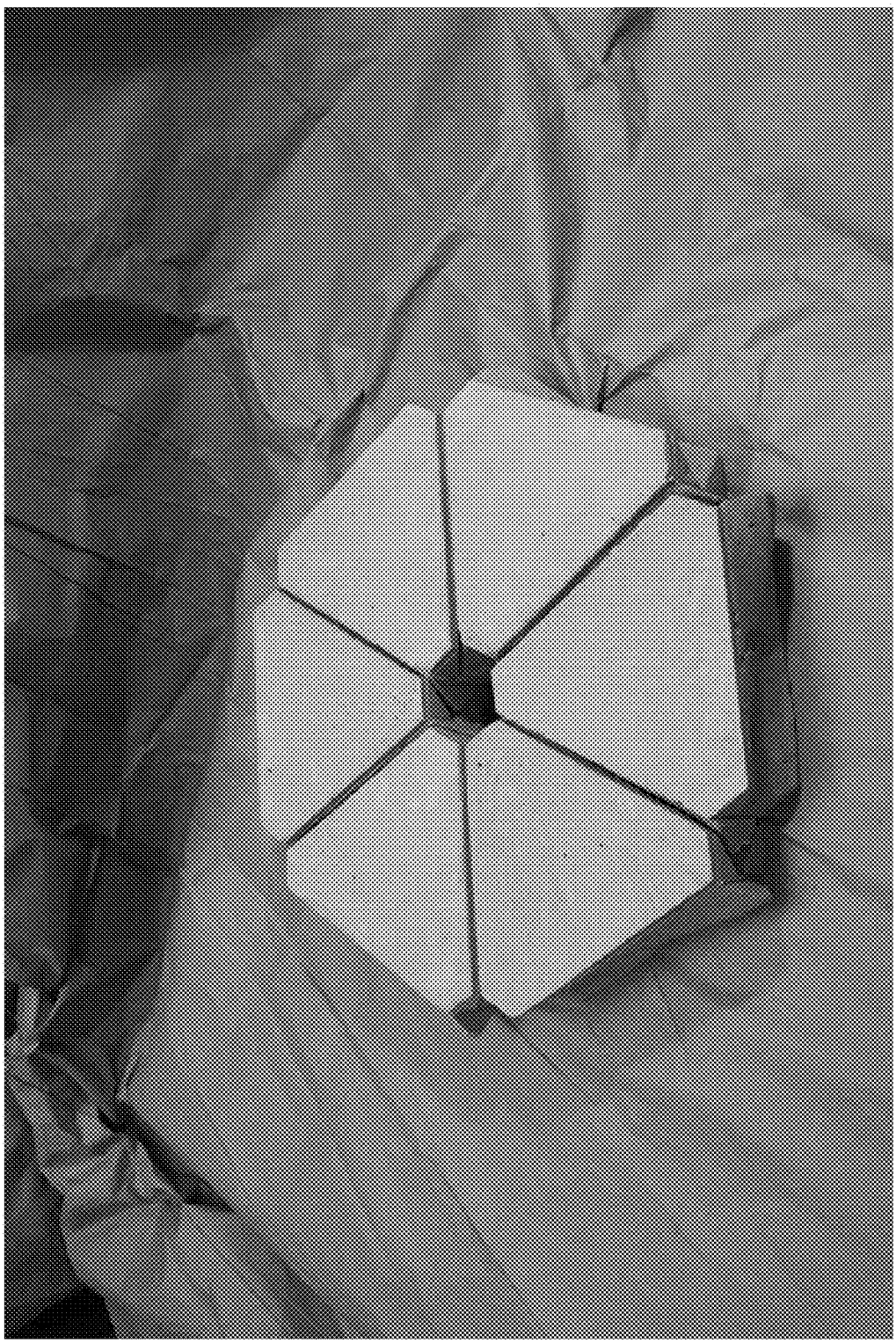
Figure 63:
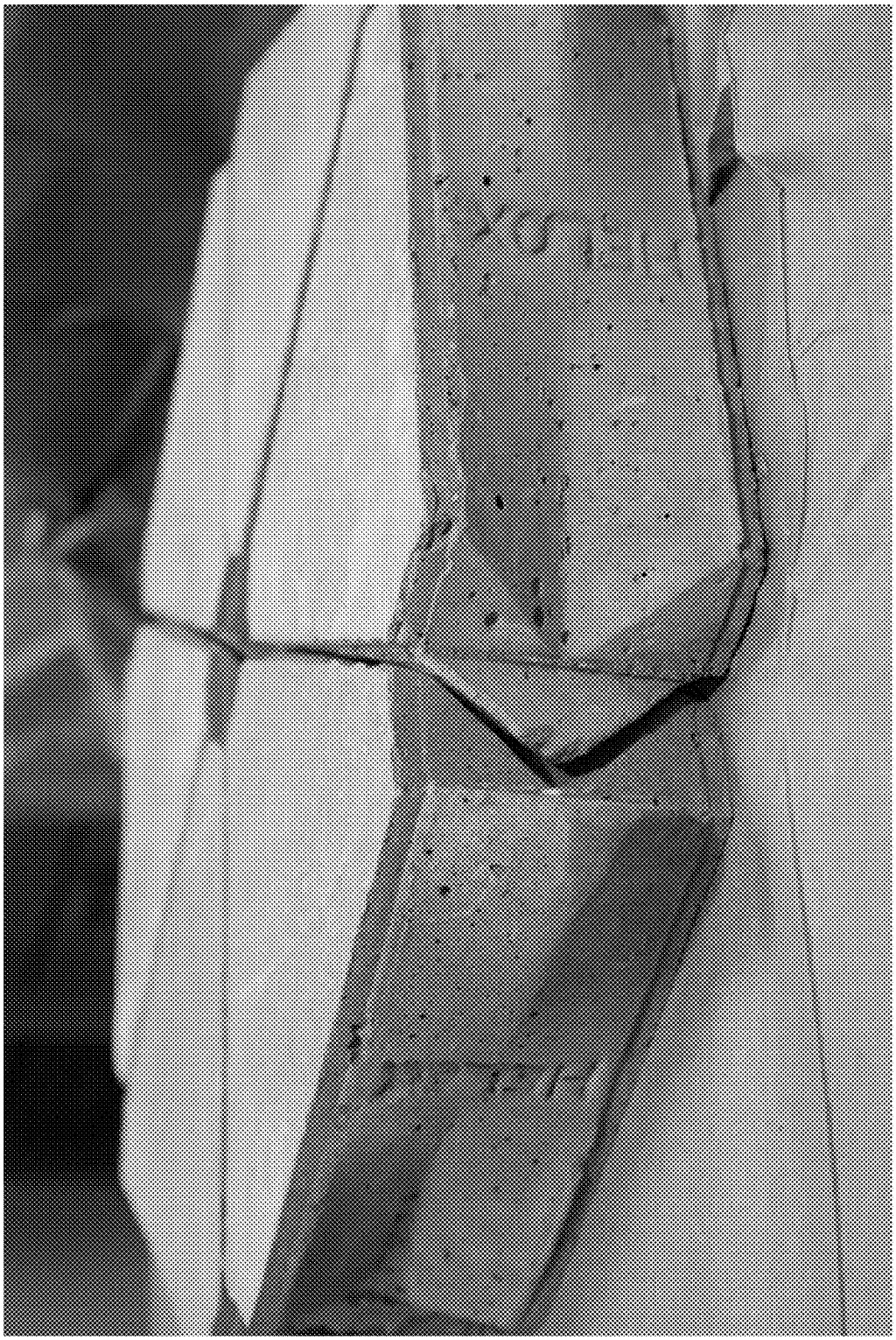
Figure 64:
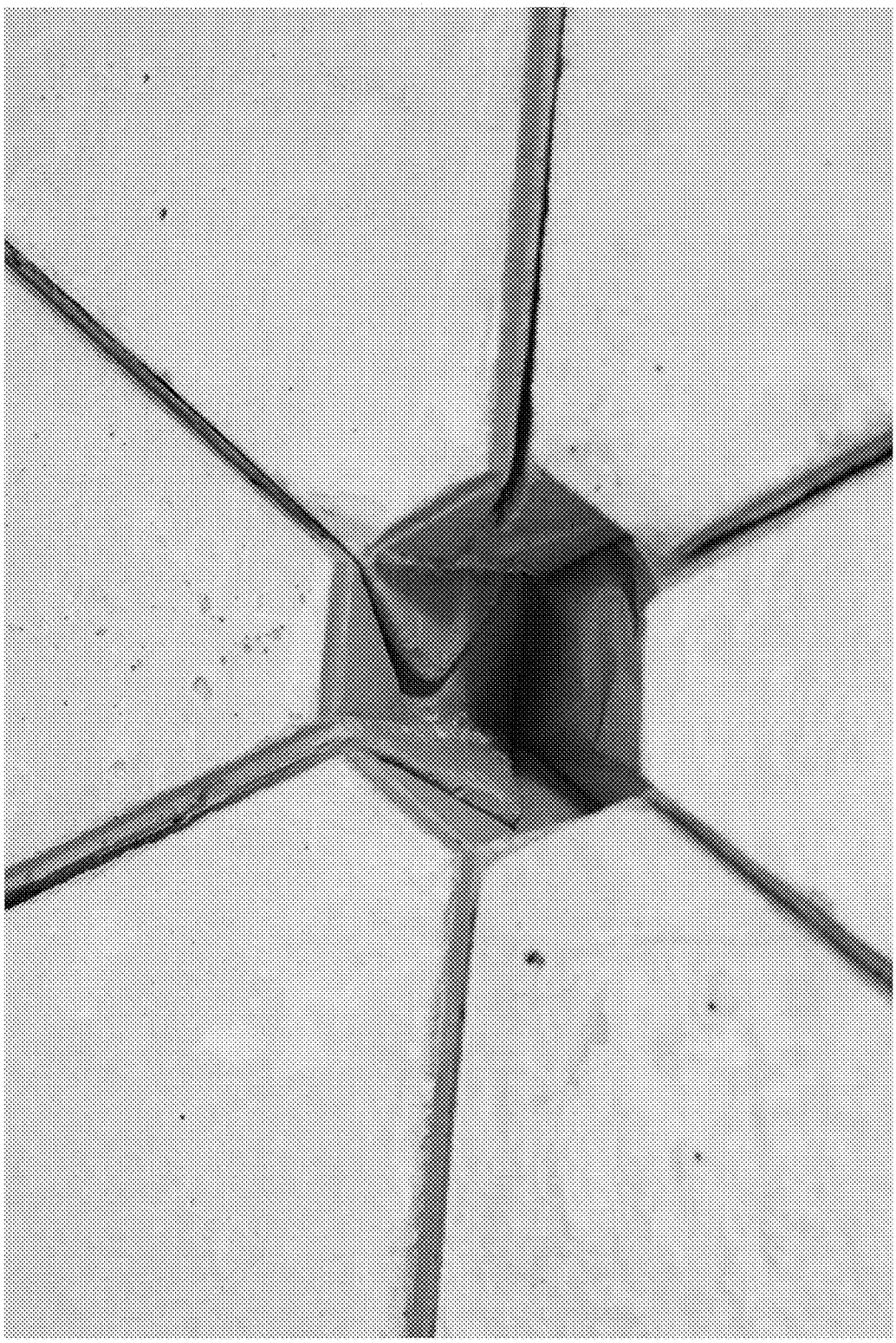
Figure 65:
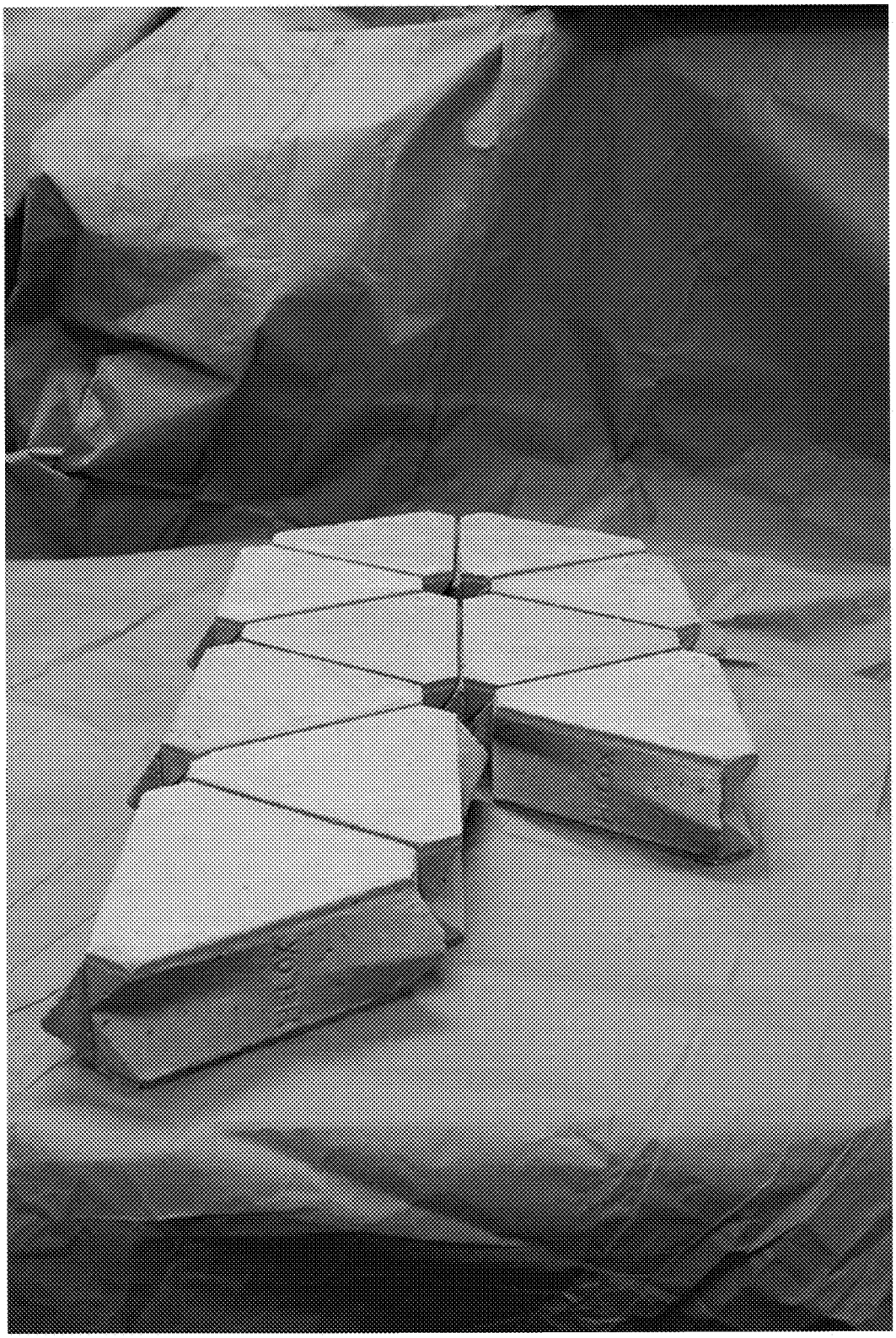
Figure 66:
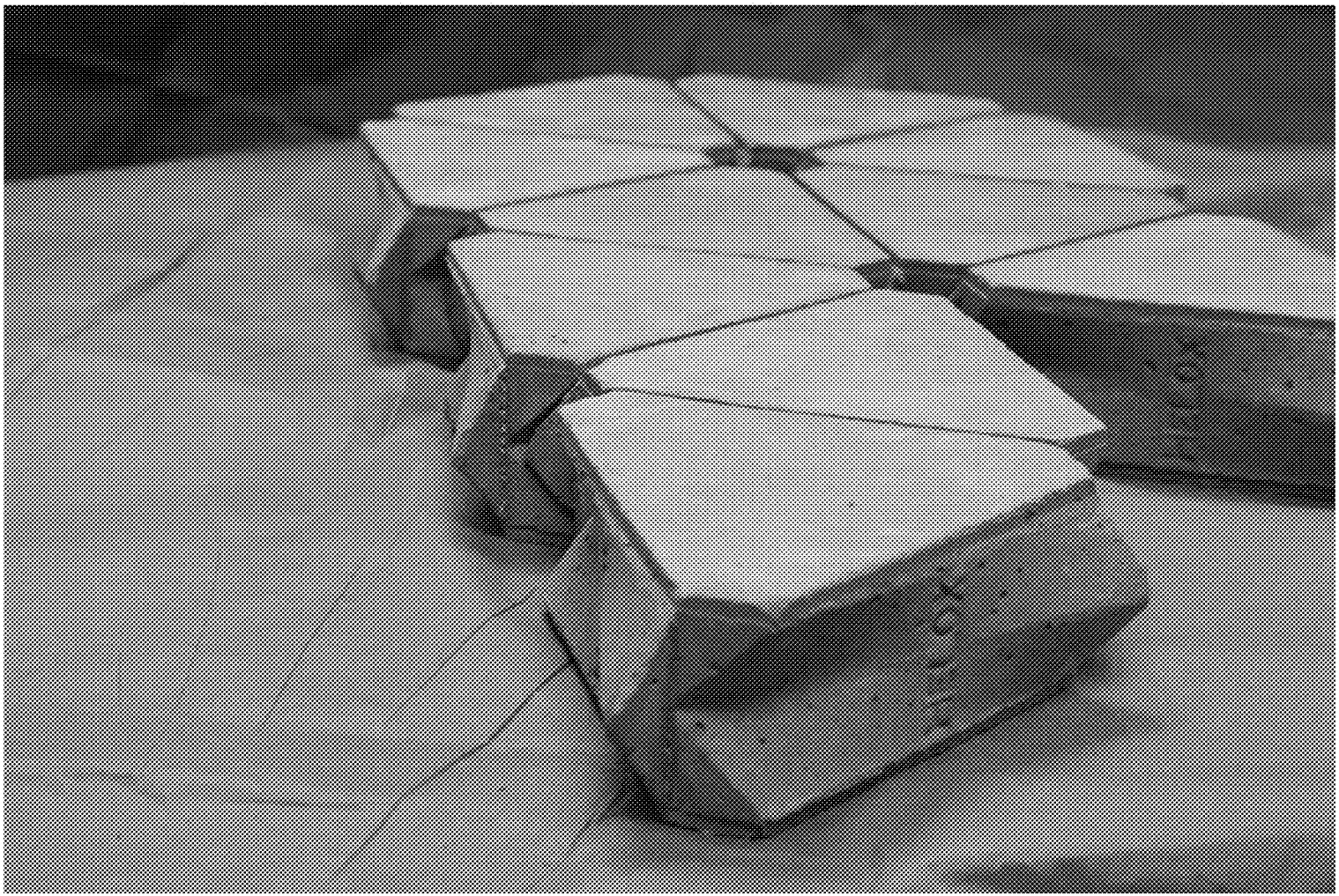
Figure 67:
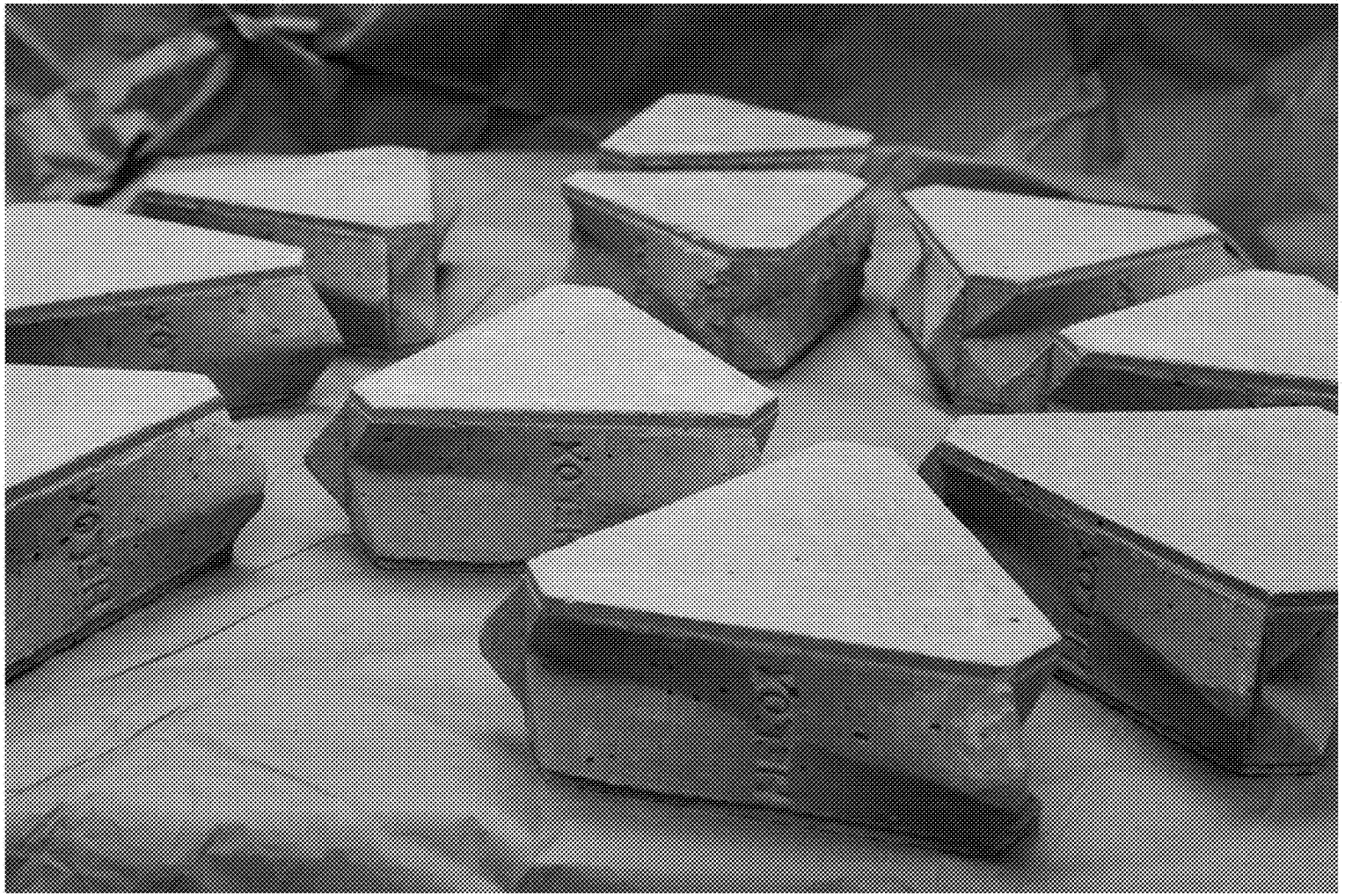
Figure 68:
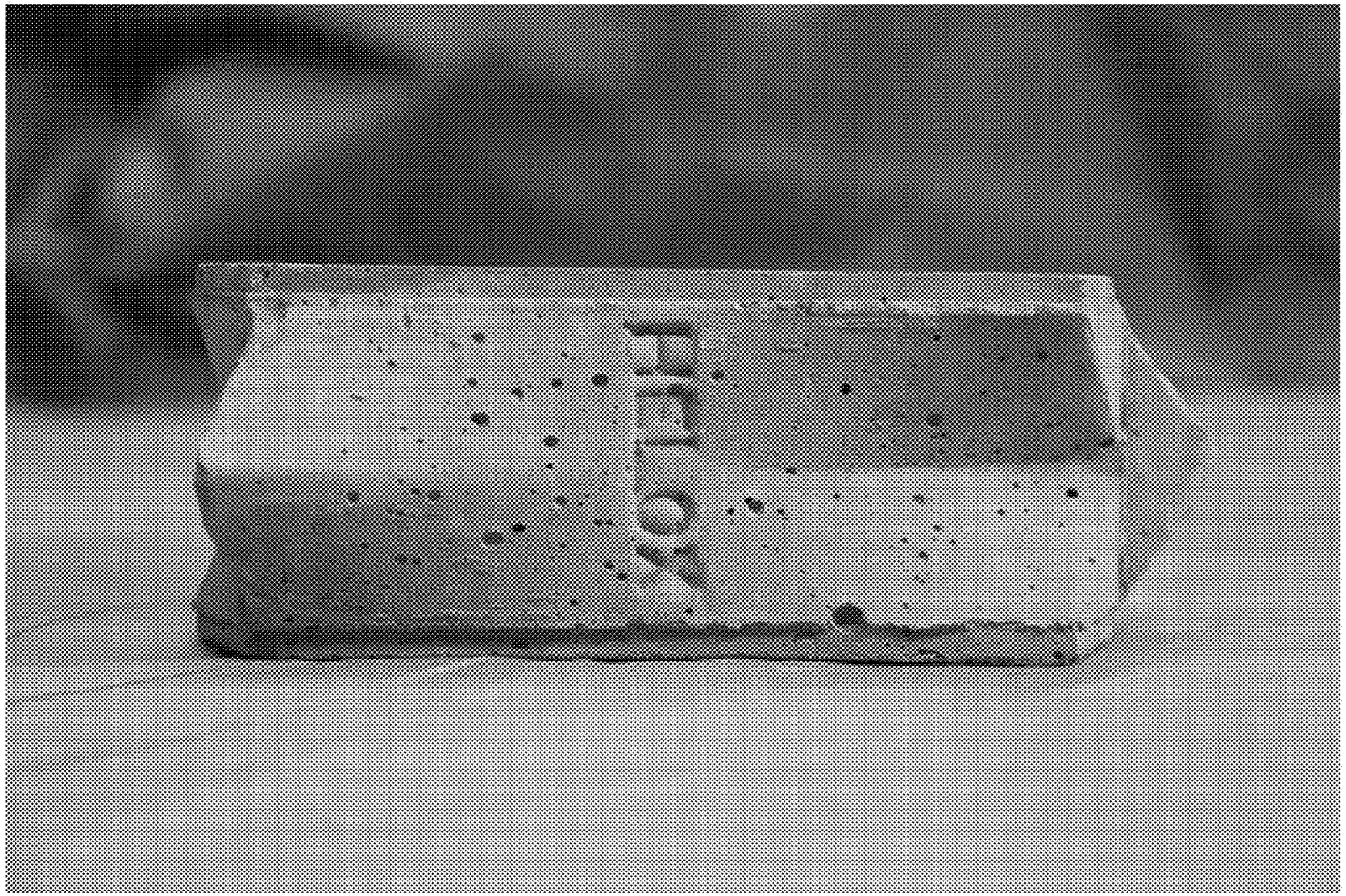
Figure 69:
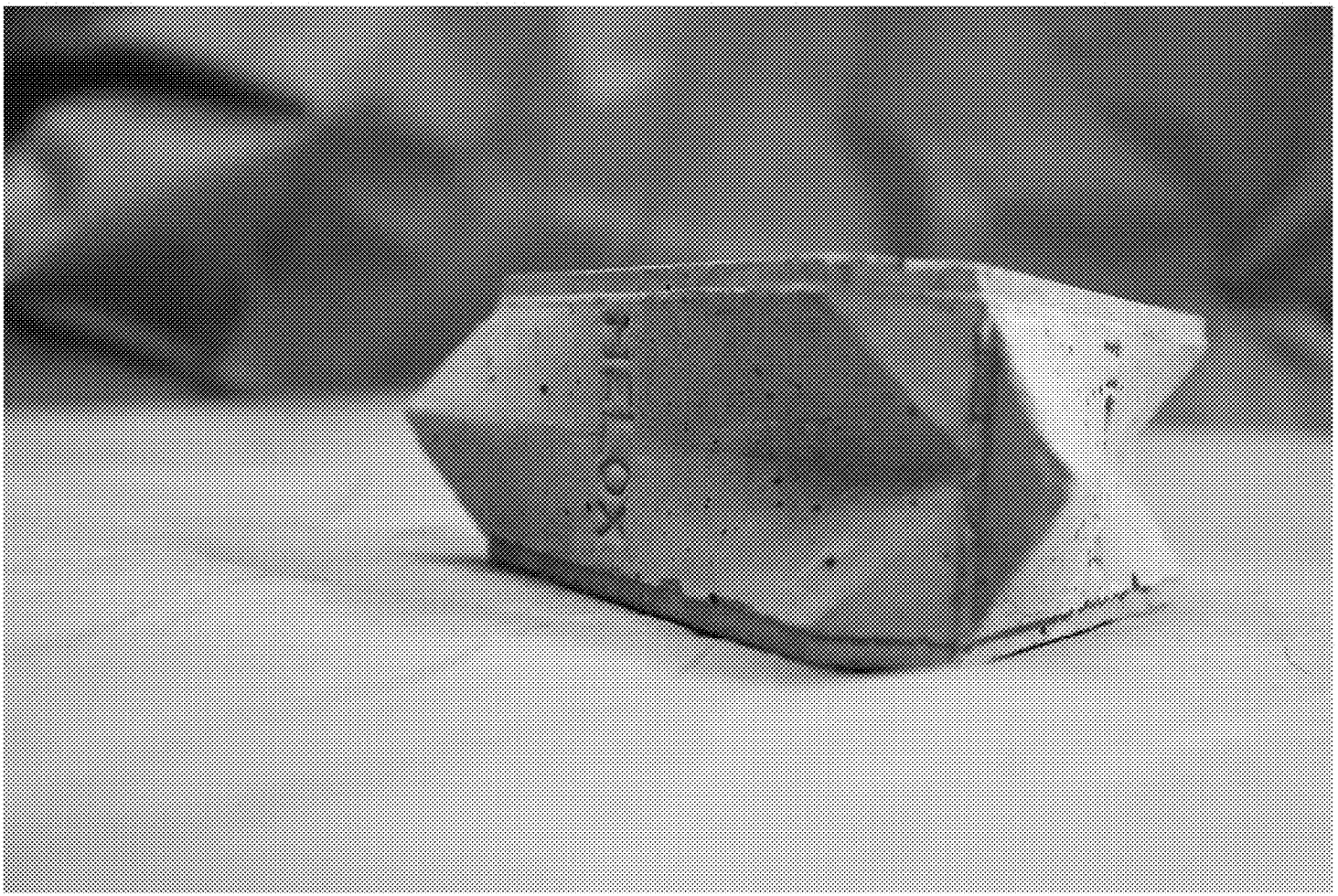
Figure 70:
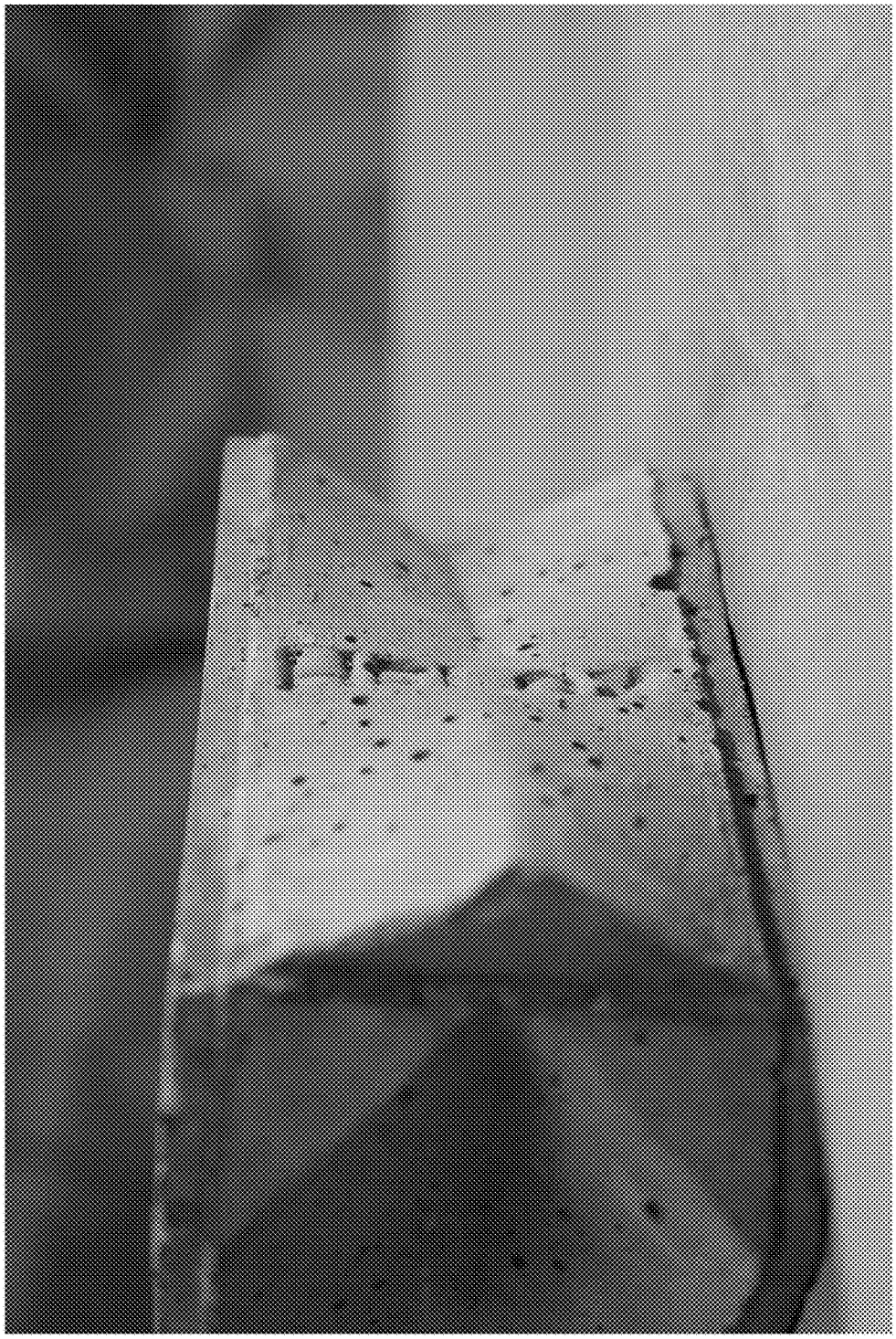
Figure 71:
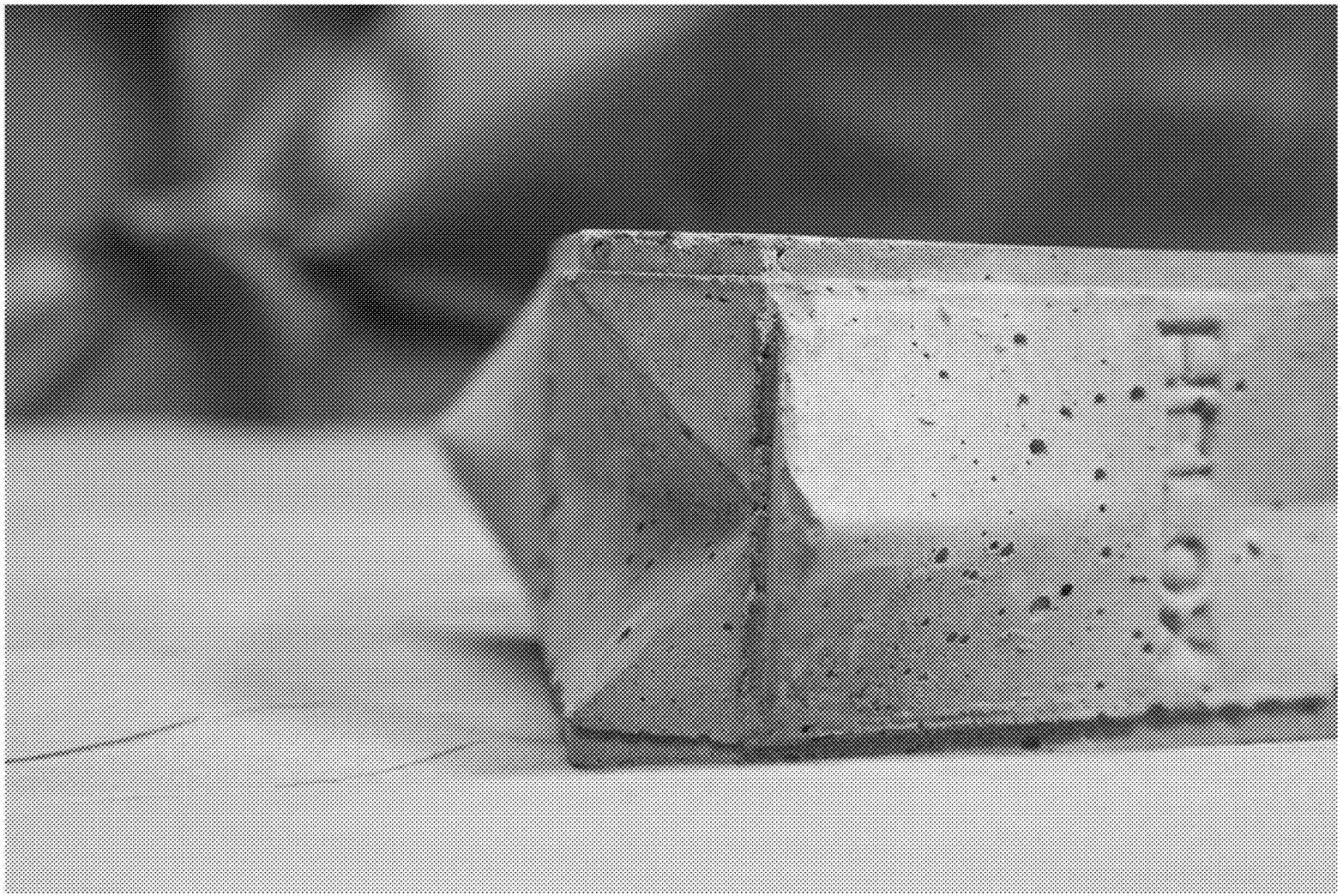
Figure 72:
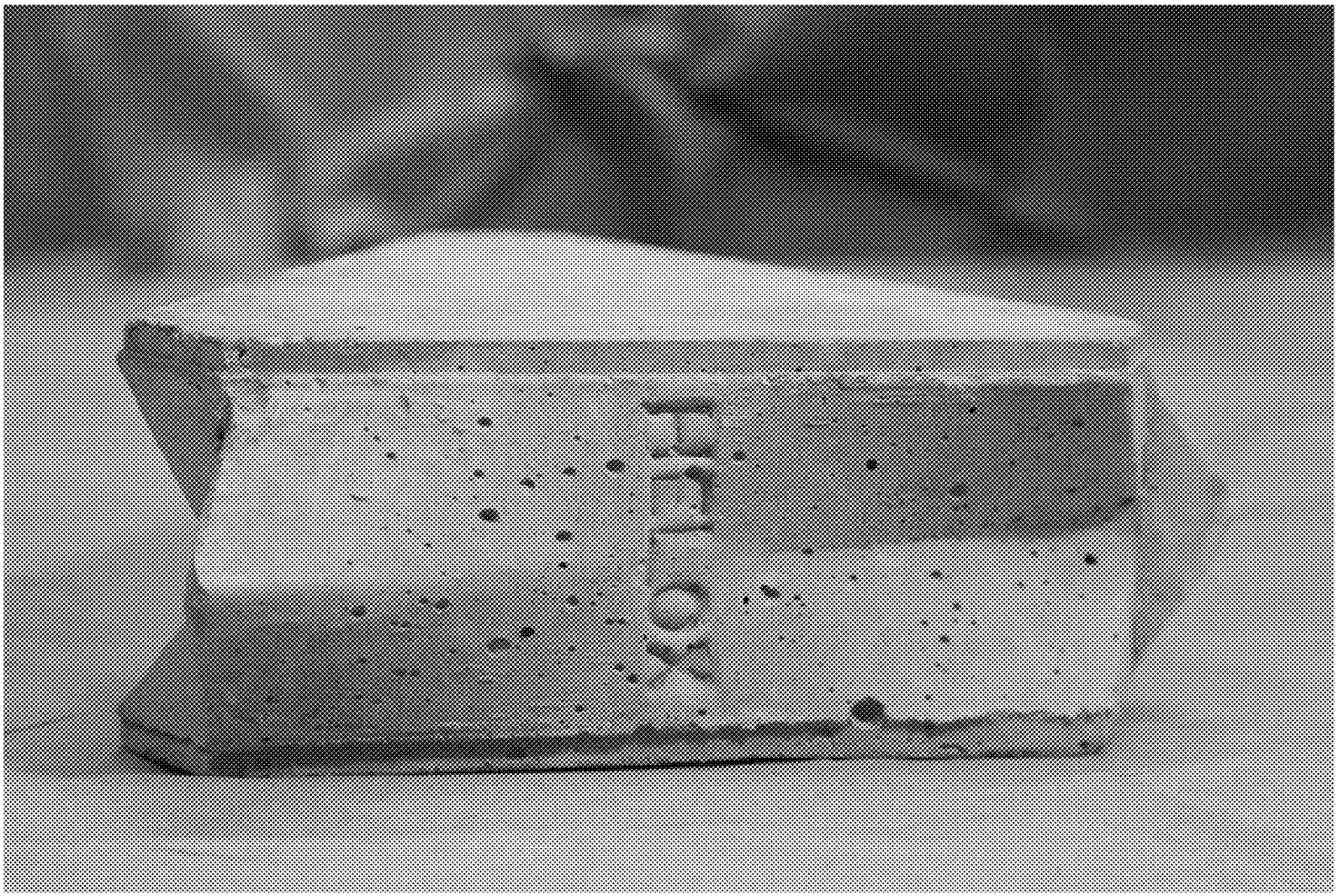
Figure 73:
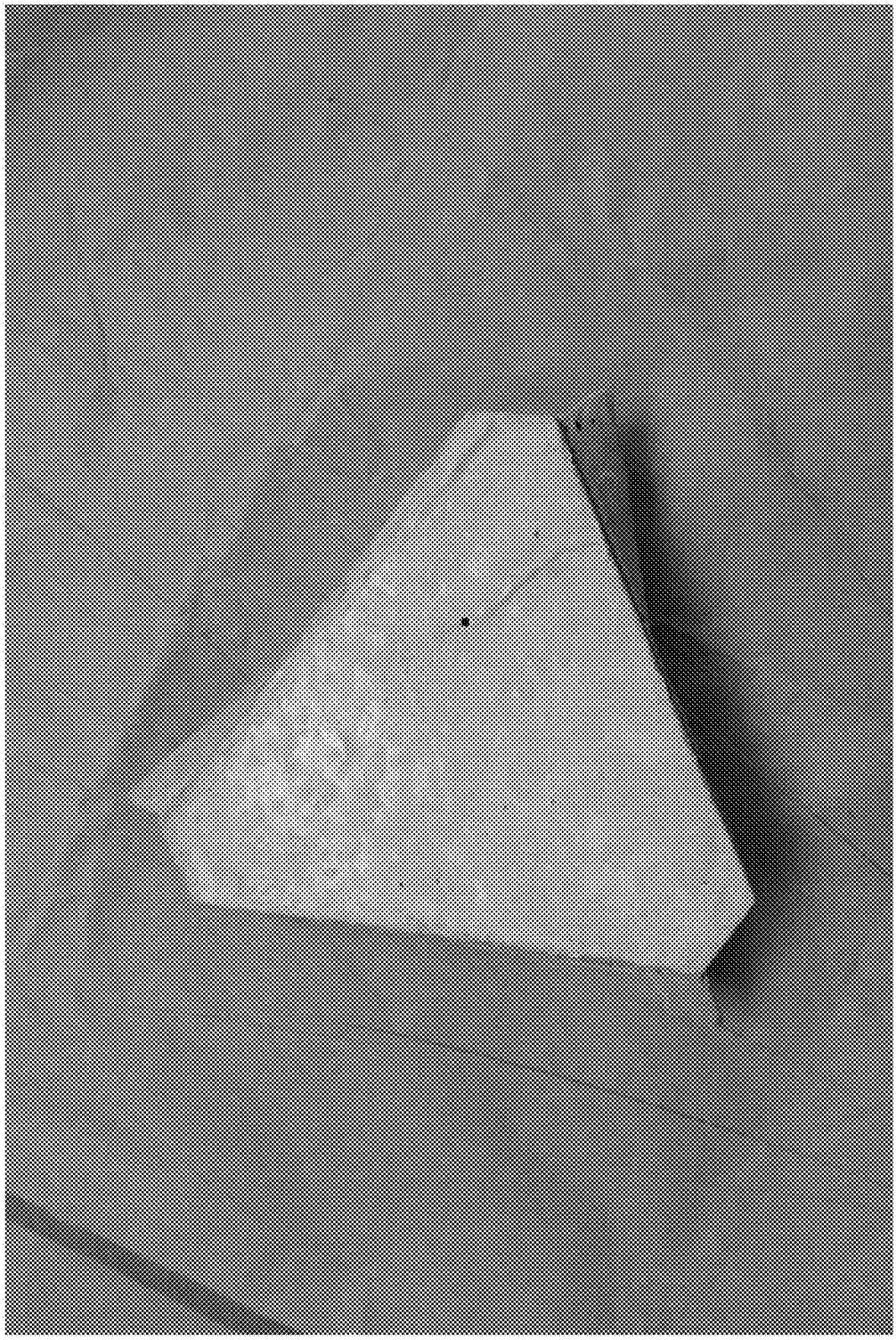
Figure 74:
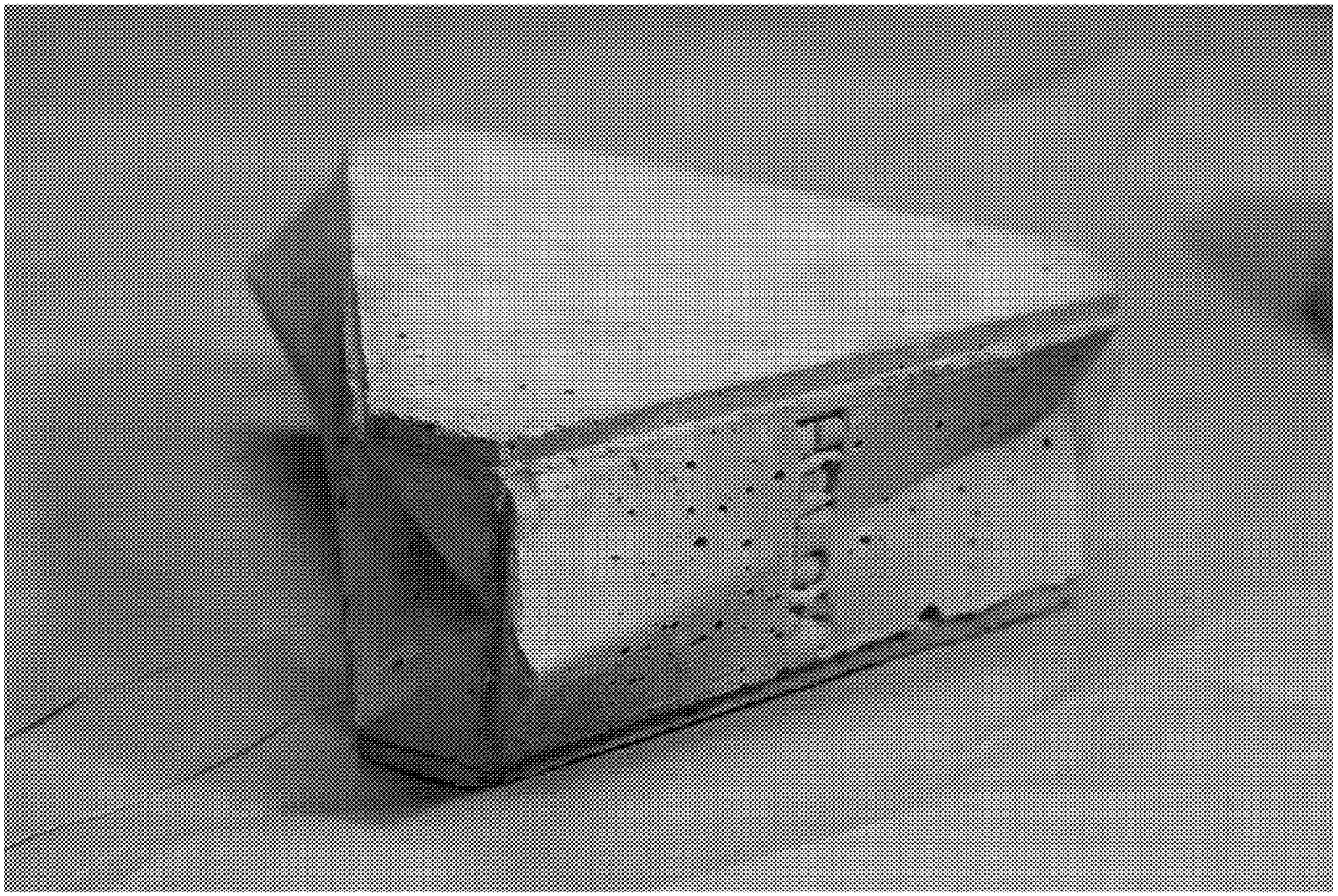
Figure 75:
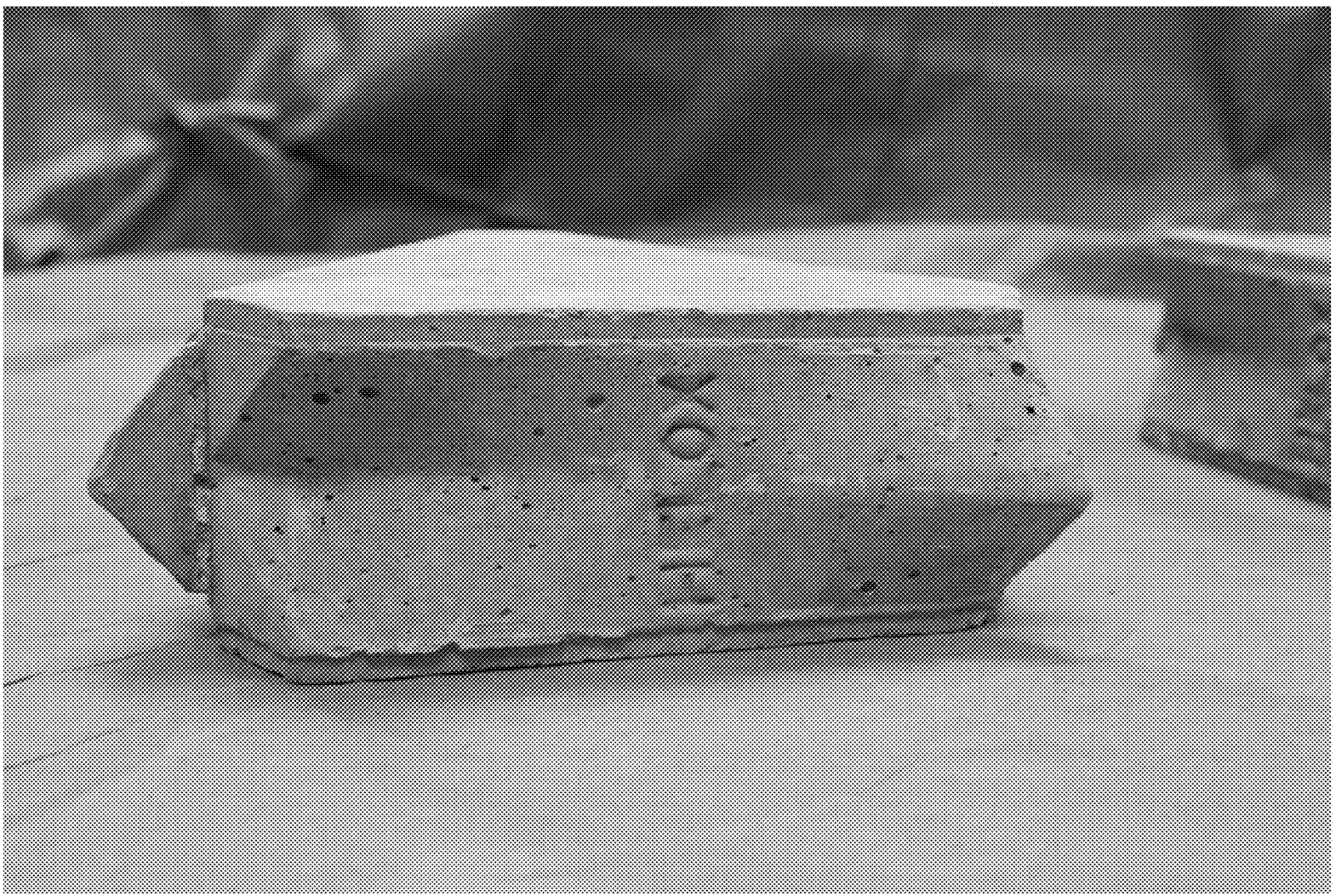
Figure 76:
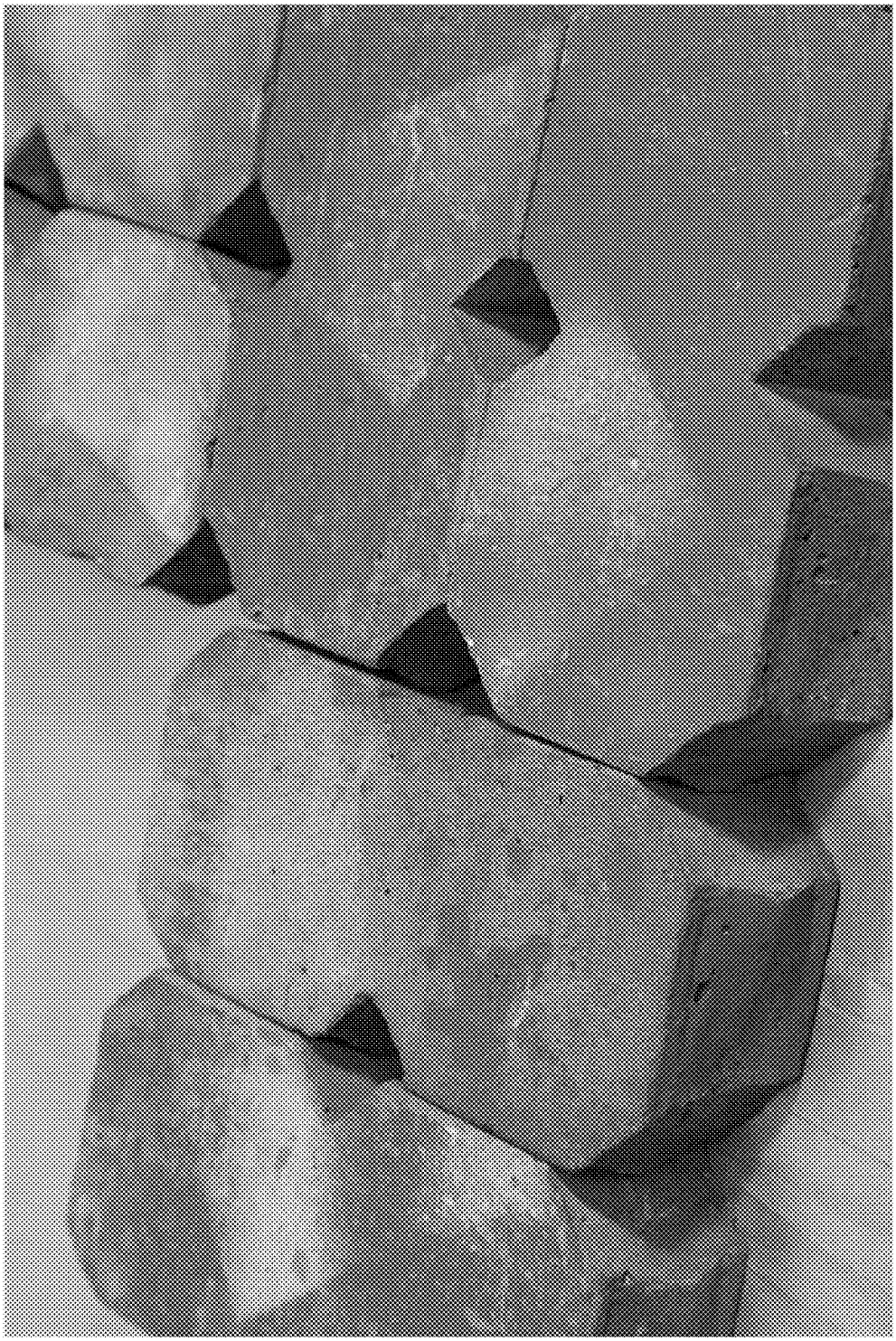
Figure 77:
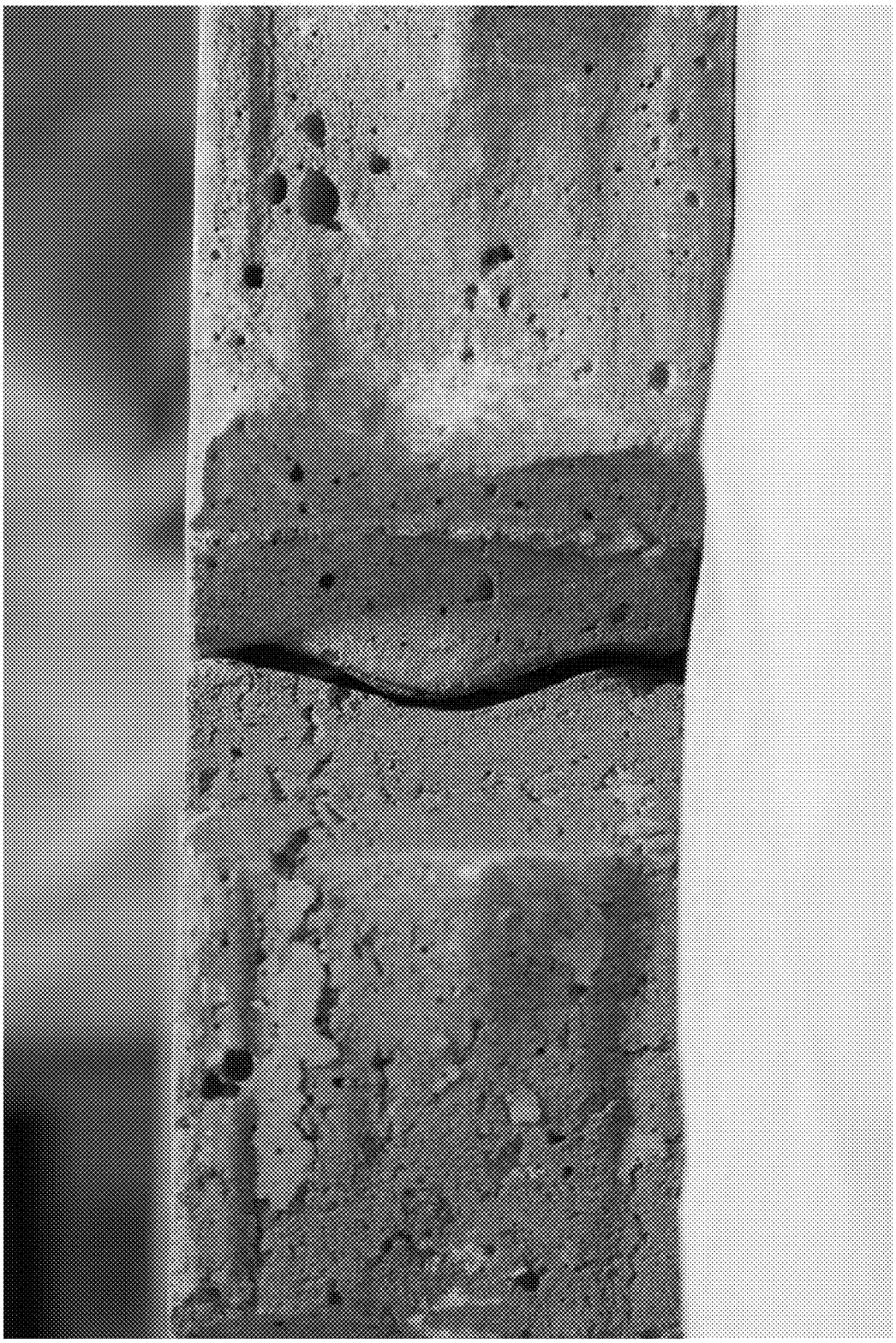
Figure 78:
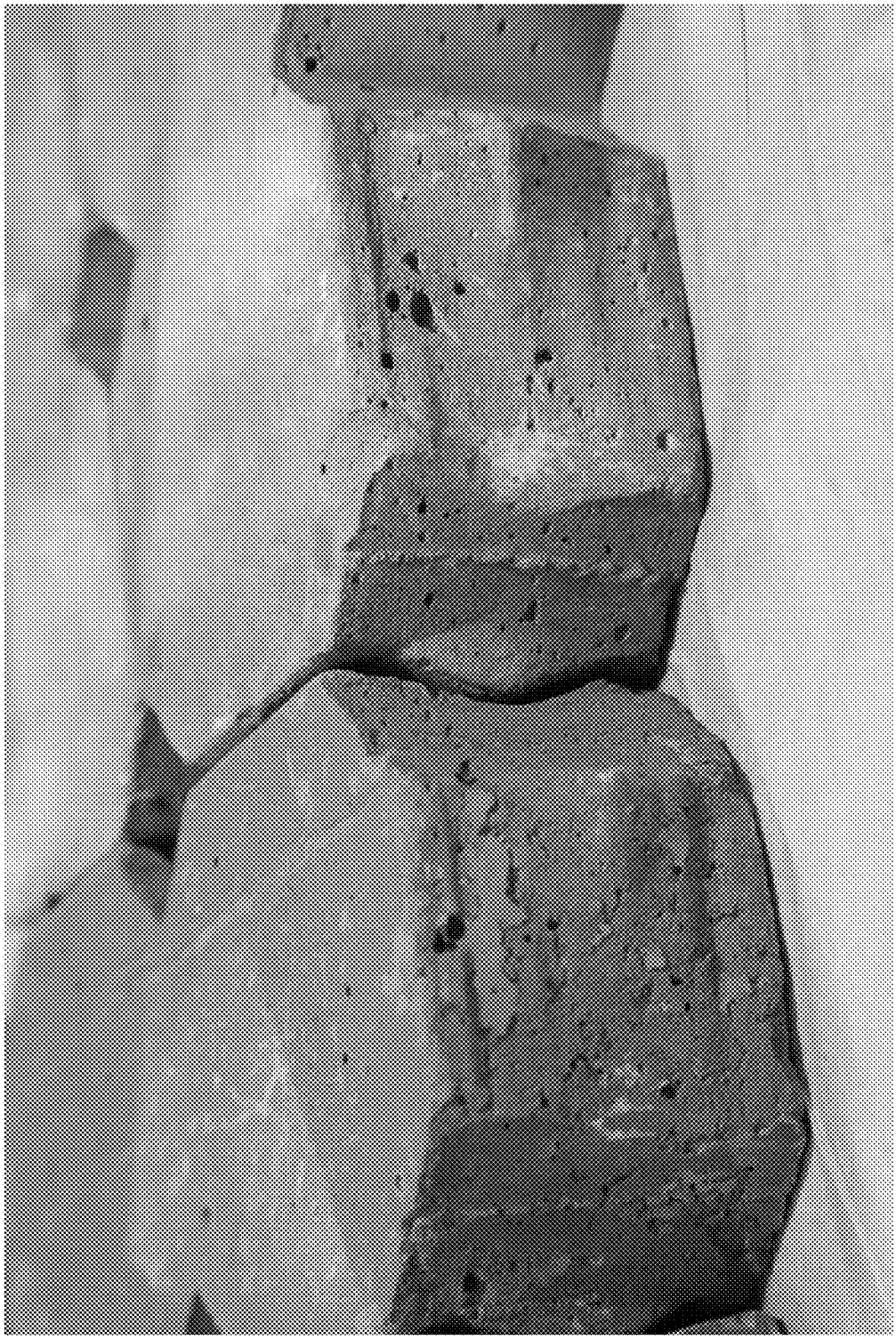
Figure 79:
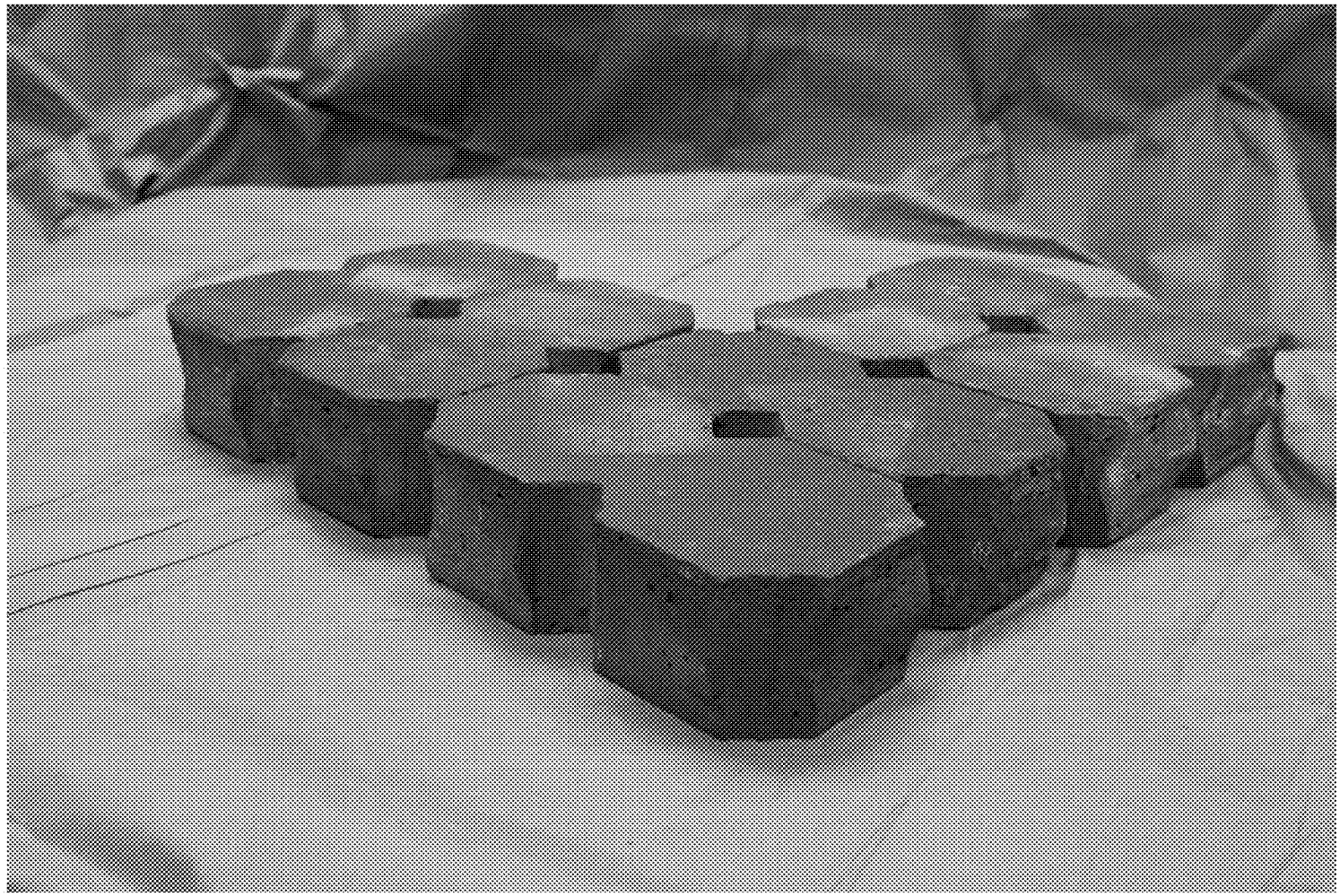
Figure 80:
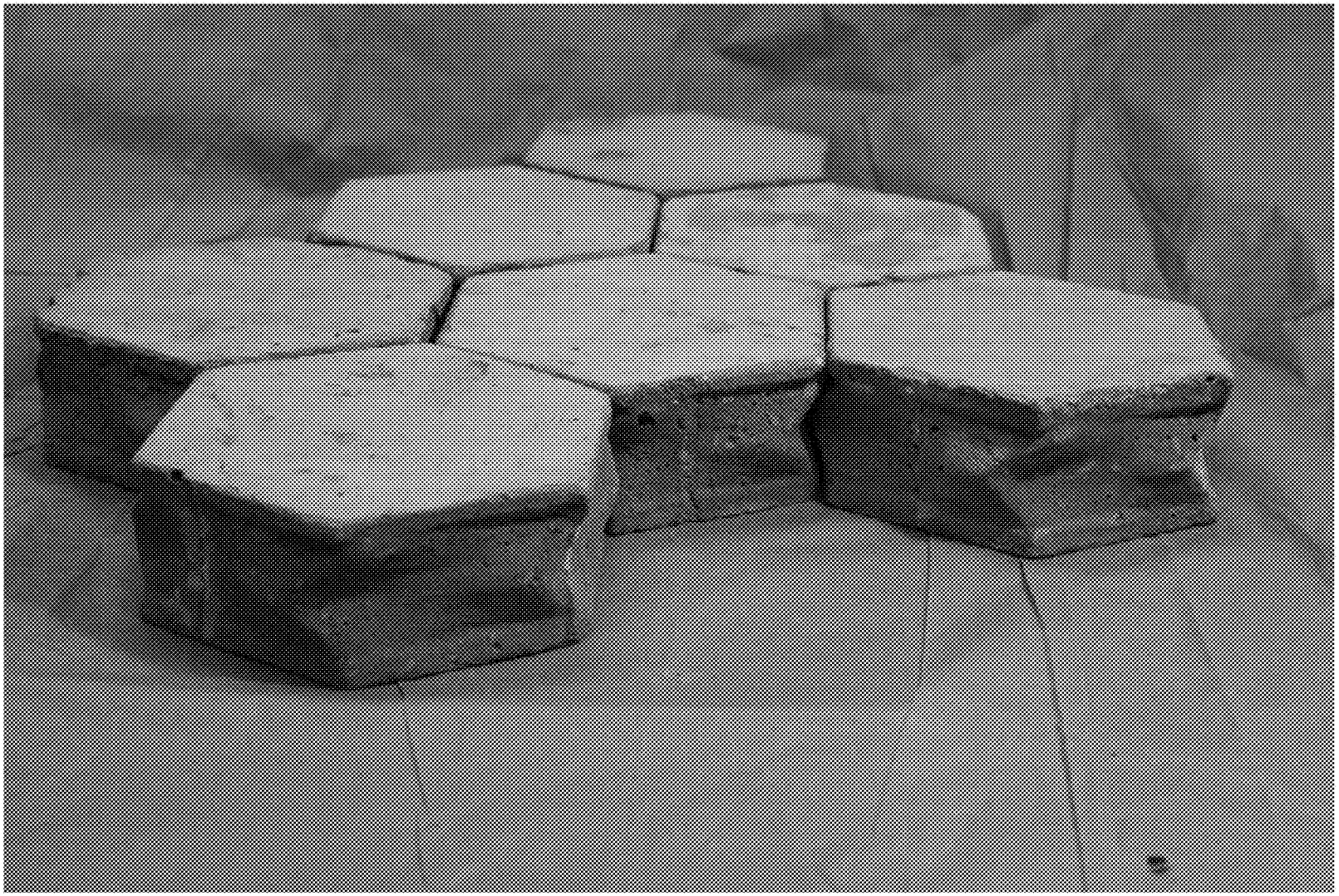
Figure 81:
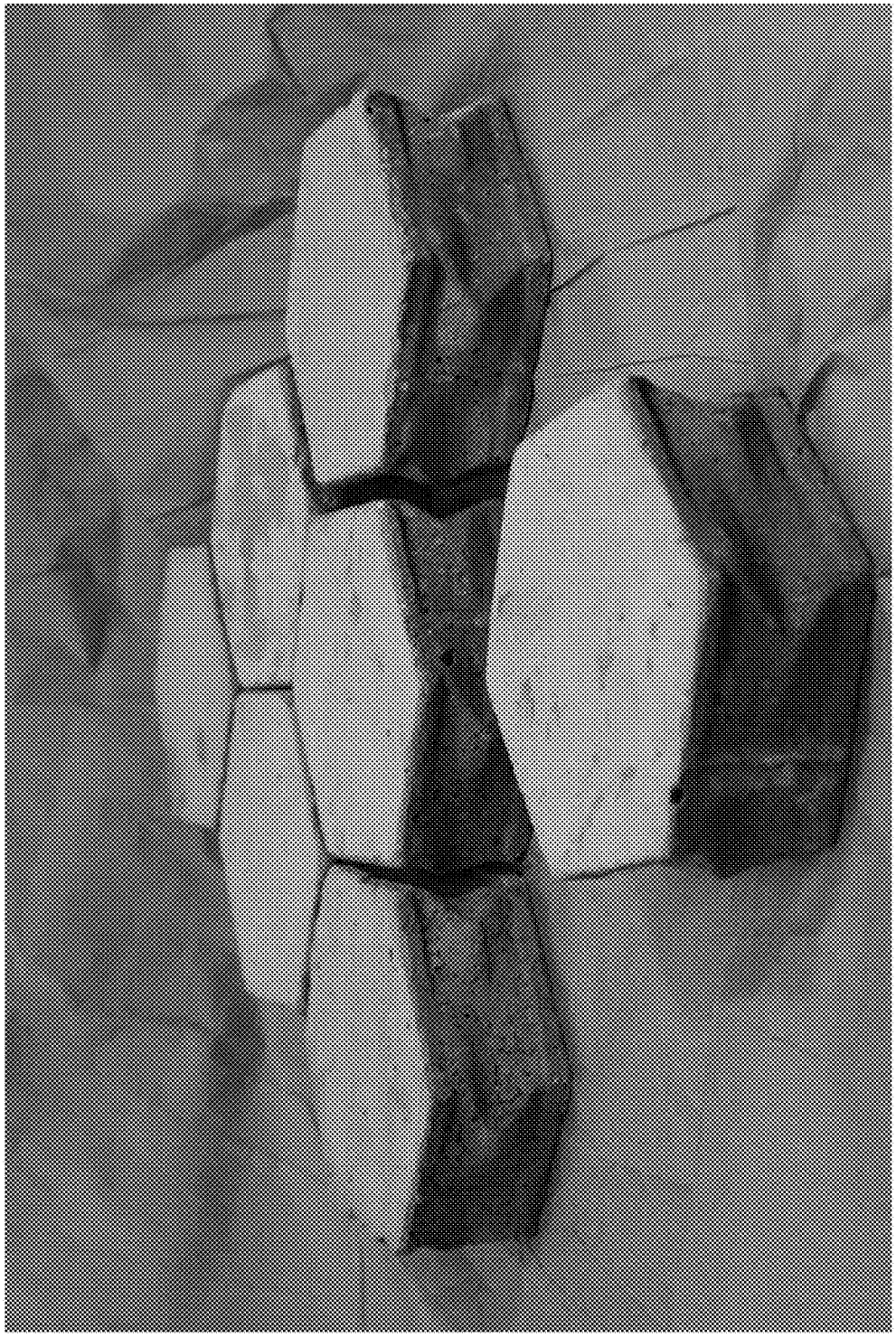
Figure 82:
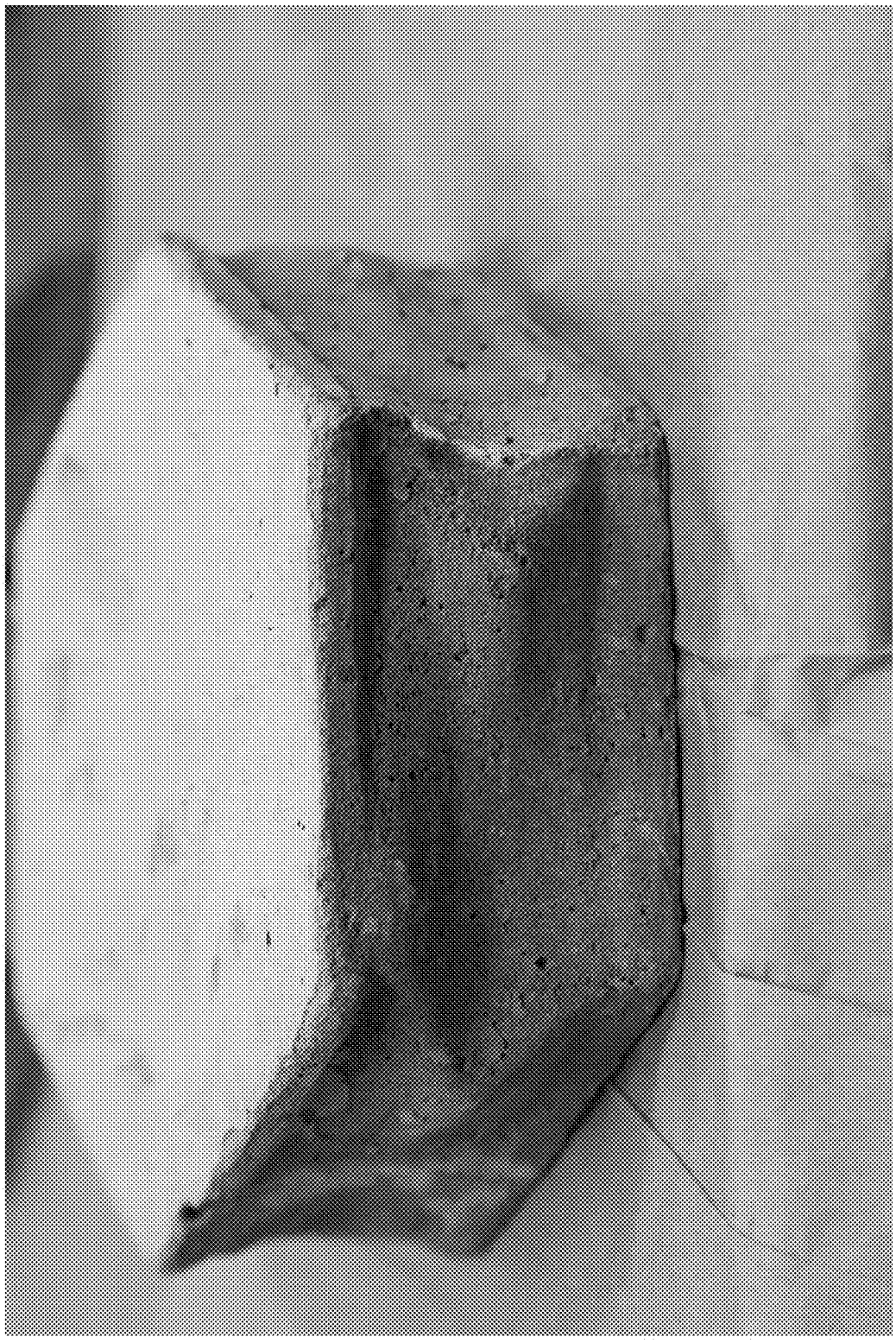
Figure 83:
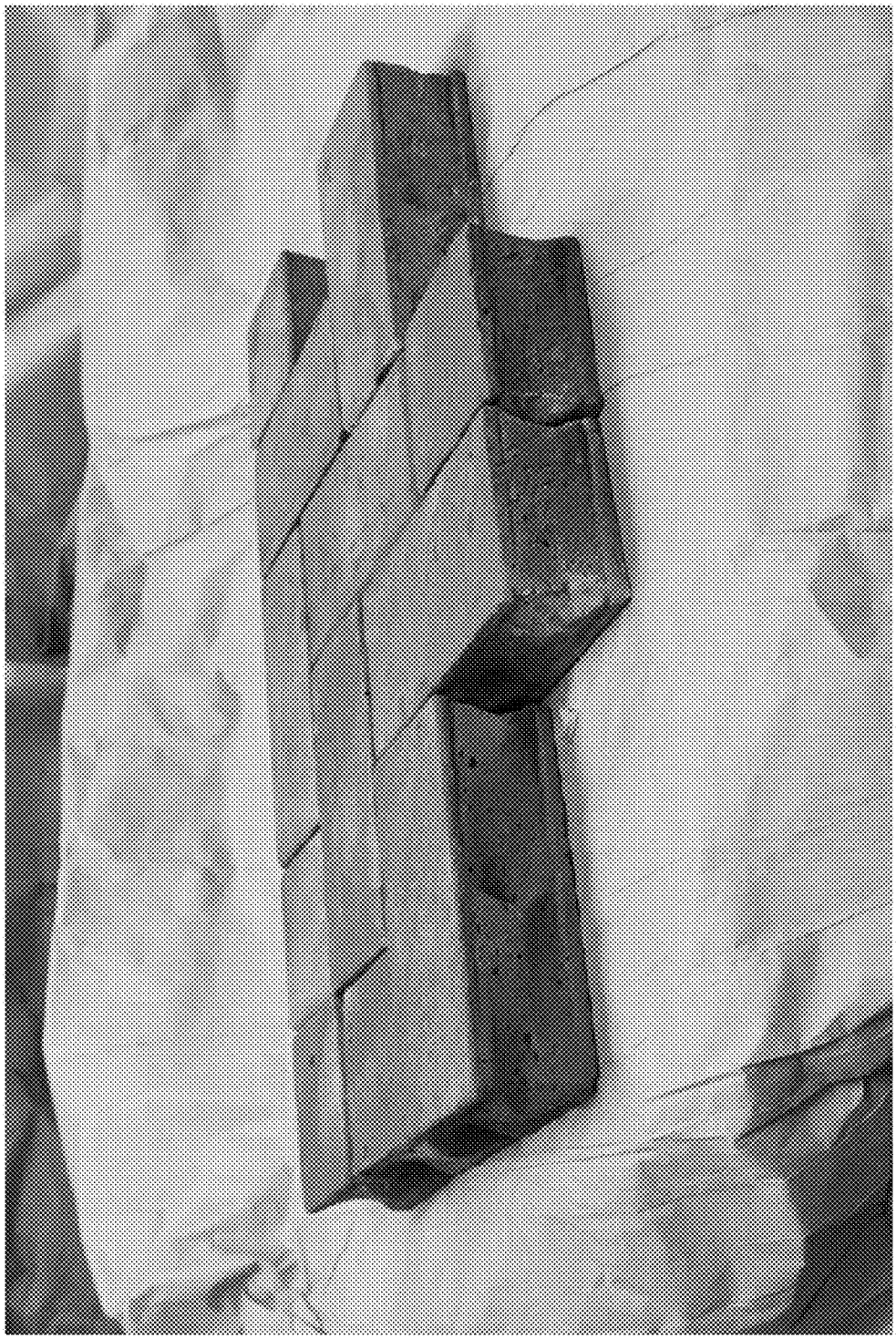

FIGS. 41-60 illustrate further versions of blocks in accordance with the disclosure, wherein the base units have chamfered corners. FIGS. 41-43 illustrate this for a square block. FIG. 43 assembles two of the basic square units into a rectangular block. As with the other blocks, there is a dividing line along the midpoint of each side of the block that is horizontal, but that passes an inflection point halfway down the side of the block, and the shape of the side of the block goes from convex to concave, or the opposite. FIG. 49 illustrates an assembly of such blocks, cooperating to define a drainage orifice at their intersection, in this case, a square. FIGS. 51-55 illustrate a modified version of the enhanced drainage block that marries two of the square units into a rectangle. FIG. 59 illustrates a mixture of square and rectangular blocks based on the square block base unit. FIG. 58 illustrates triangular blocks and FIG. 57 illustrates hexagonal blocks. Finally, FIG. 60 illustrates a mixture of blocks that are one square base unit and four square base units. FIG. 61 onward illustrate additional prototypes based on the subject disclosed embodiments.

The methods and systems of the present disclosure, as described above and shown in the drawings, provide for construction systems with superior properties as set forth above. It will be apparent to those skilled in the art that various modifications and variations can be made in the device and method of the present disclosure without departing from the spirit or scope of the disclosure. Thus, it is intended that the present disclosure include modifications and variations that are within the scope of the subject disclosure and equivalents.

What is claimed is:

1. A construction block unit having a first surface, a second surface opposite the first surface, and a plurality of sides separating the first and second surfaces that cooperate with the first and second surfaces to define a volume of the block, wherein at least one of the plurality of sides of the block is defined at least in part by first and second twisted facets that converge toward an intermediate plane located between the first and second surfaces of the block, the intermediate plane having a shape that is substantially the same as portions of the first and second surfaces that project on the intermediate plane, the intermediate plane being rotated with respect to the first and second surfaces by an angle in excess of zero degrees, each of the first and second facets having a surface that twists along the side of the block, the twisting surfaces of the first and second twisted facets cooperating to define a surface that transitions from a concave surface to a convex surface along the side of the block.

2. The construction block unit of claim 1, wherein each side of the block has at least one pair of twisted facets and the intermediate plane defines a peripheral edge that is continuous around a perimeter of the block.

3. The construction block unit of claim 1, wherein each side of the block has at least one pair of twisted facets and wherein the block has at least one chamfered corner, and further where the intermediate plane defines a peripheral edge that is continuous around a perimeter of the block except for interruptions at the at least one chamfered corner.

4. The construction block unit of claim 1, wherein the predetermined angle is between about five degrees and about fifteen degrees.

5. The construction block unit of claim 1, wherein the first and second surfaces of the block are square in shape.

6. The construction block unit of claim 1, wherein the construction block includes a plurality of adjacent rotated intermediate planes laying in the same plane.

7. The construction block unit of claim 1, wherein the first and second surfaces of the block are triangular in shape.

8. The construction block unit of claim 1, wherein the first and second surfaces of the block are hexagonal in shape.

9. The construction block unit of claim 1, wherein the first and second surfaces of the block are rectangular in shape.

10. The construction block unit of claim 6, wherein the first and second surfaces of the block are rectangular in shape.

11. The construction block unit of claim 6, wherein the first and second surfaces of the block are square in shape.

12. The construction block unit of claim 1, wherein at least one of the first and second twisted facets has a smooth, continuous surface.

13. The construction block unit of claim 1, wherein the block includes a reveal along at least one of the first and second surfaces.

14. The construction block unit of claim 1, wherein the intermediate plane is parallel to at least one of the first and second surfaces.

15. The construction block unit of claim 1, wherein the block includes two parallel intermediate planes laterally spaced from each other and at least four twisted facets on each side of the block.

16. The construction block unit of claim 1, wherein the block includes three parallel intermediate planes laterally spaced from each other and at least six twisted facets on each side of the block.

17. The construction block unit of claim 1, wherein the first and second twisted facets define an inflection point proximate the middle of the intermediate plane dividing the first and second twisted facets, wherein the facets are neither concave nor convex at the inflection point.

18. The construction block unit of claim 1, wherein the intermediate plane has the same dimensions as the portions of the first and second surfaces that project on the intermediate plane.

19. The construction block unit of claim 1, wherein less than all of the sides in the plurality of sides include a twisted facet.

20. A wall or a ground covering made from wall blocks or pavers according to claim 1.

* * * * *

UNITED STATES PATENT AND TRADEMARK OFFICE

CERTIFICATE OF CORRECTION

PATENT NO. : 8,667,752 B2
APPLICATION NO. : 13/844776
DATED : March 11, 2014
INVENTOR(S) : Robert Pollack It is certified that error appears in the above-identified patent and that said Letters Patent is hereby corrected as shown below:

On the Title Page: Item (63) "Related U.S. Application Data", the patent incorrectly reads as follows:
"Continuation-in-part of application No. 13/633,866, filed on October 2, 2012, which is a continuation of application No. 13/101,334, filed on May 5, 2011, now abandoned, which is a continuation of application No. 12/823,948, filed on Jun. 25, 2010, now abandoned."

On the Title Page: Item (63) "Related U.S. Application Data", the patent should read as follows:
--Continuation-in-part of application No. 13/633,866, filed on October 2, 2012, which is a continuation of application No. 13/101,334, filed on May 5, 2011, now abandoned, which is a continuation-in-part of application No. 12/823,948, filed on Jun. 25, 2010, now abandoned.--

Signed and Sealed this
Third Day of June, 2014

Michelle K. Lee

Michelle K. Lee
*Deputy Director of the United States Patent and Trademark Office*